US010731411B2

(12) United States Patent
Holt et al.

(10) Patent No.: US 10,731,411 B2
(45) Date of Patent: Aug. 4, 2020

(54) END CAPS FOR ARCHITECTURAL COVERINGS

(71) Applicant: Hunter Douglas, Inc., Pearl River, NY (US)

(72) Inventors: Ronald Holt, Westminster, CO (US); Stephen T. Wisecup, Niwot, CO (US); Nicholas E. VanderKolk, Boulder, CO (US); Peter Zagone, Broomfield, CO (US)

(73) Assignee: Hunter Douglas, Inc., Pearl River, NY (US)

( * ) Notice: Subject to any disclaimer, the term of this patent is extended or adjusted under 35 U.S.C. 154(b) by 346 days.

(21) Appl. No.: 15/788,222

(22) Filed: Oct. 19, 2017

(65) Prior Publication Data

US 2018/0106102 A1 Apr. 19, 2018

Related U.S. Application Data

(60) Provisional application No. 62/410,342, filed on Oct. 19, 2016.

(51) Int. Cl.
*E06B 9/72* (2006.01)
*E06B 9/42* (2006.01)
(Continued)

(52) U.S. Cl.
CPC ..... *E06B 9/42* (2013.01); *E06B 9/50* (2013.01); *E06B 9/72* (2013.01); *H01Q 1/22* (2013.01)

(58) Field of Classification Search
CPC ..... E06B 9/17; E06B 9/17007; E06B 9/174; E06B 9/34; E06B 9/40; E06B 9/42; E06B 9/44; E06B 9/50; E06B 9/72; E06B 9/70
See application file for complete search history.

(56) References Cited

U.S. PATENT DOCUMENTS 4,096,903 A * 6/1978 Ringle, III ..... E06B 9/264 160/107
4,417,185 A * 11/1983 Bullat ..... E06B 9/74 318/2

(Continued)

OTHER PUBLICATIONS

United States Patent and Trademark Office, "Non-Final Office action," issued in connection with U.S. Appl. No. 15/193,810, dated Feb. 15, 2018, 15 pages.

(Continued)

*Primary Examiner* — Johnnie A. Shablack
(74) *Attorney, Agent, or Firm* — Hanley, Flight & Zimmerman, LLC

(57) ABSTRACT

Example end caps for architectural coverings are disclosed herein. An example end cap for an architectural covering includes a first cable-routing element provided in a first region of the end cap and a second cable-routing element provided in a second region of the end cap spaced apart from the first region of the end cap. The example end cap includes a cable-directing element and a motor mount configured to couple with a portion of a motor having a cable extending therefrom. In the example end cap, the cable-directing element is configured to engage a transition portion of the cable and to selectively route a second portion of the cable from the cable-directing element to either the first cable-routing element or the second cable-routing element.

26 Claims, 13 Drawing Sheets

(51) Int. Cl.
*E06B 9/50* (2006.01)
*H01Q 1/22* (2006.01)

(56) References Cited

U.S. PATENT DOCUMENTS 4,758,824 A 7/1988 Young
5,711,360 A * 1/1998 Viotte ..... E06B 9/62 160/133
6,474,393 B1 11/2002 Welfonder
6,497,267 B1 12/2002 Azar et al.
6,517,136 B2 * 2/2003 De Ceuster ..... B60R 5/047 160/24
7,057,360 B1 * 6/2006 Hsu ..... E06B 9/72 318/105
7,931,068 B2 * 4/2011 Carmen, Jr. ..... E06B 9/68 160/120
9,091,118 B2 * 7/2015 Anderson ..... E06B 9/72
9,334,688 B2 * 5/2016 Colson ..... E06B 9/78
9,410,371 B2 * 8/2016 Faller ..... E06B 9/322
9,644,424 B2 * 5/2017 Slivka ..... E06B 9/42
9,677,329 B2 * 6/2017 Knowles ..... E06B 9/262
9,702,189 B2 * 7/2017 Chen ..... E06B 9/42
9,765,566 B1 * 9/2017 Chen ..... E06B 9/42
10,000,968 B2 * 6/2018 Bodet ..... E06B 9/72
10,294,717 B2 * 5/2019 Geiger ..... A47H 1/13
10,519,713 B2 12/2019 Holt et al.
2002/0027184 A1 3/2002 Kovach et al.
2004/0129849 A1 7/2004 Walker et al.
2004/0154757 A1 8/2004 Osinga
2005/0185273 A1 * 8/2005 Lee ..... G03B 21/56 359/461
2006/0005985 A1 * 1/2006 L'Henaff ..... H05K 5/0204 174/50
2006/0158045 A1 * 7/2006 Speri ..... E06B 9/72 310/1
2007/0056697 A1 * 3/2007 Chen ..... E06B 9/70 160/310
2009/0242145 A1 * 10/2009 Sheu ..... E06B 9/322 160/311
2010/0175838 A1 7/2010 Faller et al.
2011/0253320 A1 10/2011 Baugh et al.
2012/0031567 A1 2/2012 Shier et al.
2012/0073624 A1 * 3/2012 Nocito ..... E04F 10/0633 136/245
2013/0199735 A1 8/2013 Colson et al.
2015/0075732 A1 1/2015 Kirby et al.
2015/0034258 A1 2/2015 Bohlen et al.
2015/0034259 A1 2/2015 Bohlen et al.
2015/0159430 A1 * 6/2015 Huang ..... A47H 1/04 160/168.1 P
2016/0123076 A1 5/2016 Kirby
2017/0006740 A1 1/2017 Holt et al.
2017/0167193 A1 6/2017 Slivka
2017/0241201 A1 8/2017 Buccola, Jr. et al.
2018/0023340 A1 * 1/2018 Goldberg ..... E06B 9/56
2018/0106105 A1 * 4/2018 Anthony ..... E06B 9/72
2018/0163465 A1 * 6/2018 Biedermann ..... E06B 9/50
2018/0310745 A1 * 11/2018 Giri ..... E06B 9/50
2019/0032404 A1 * 1/2019 Chacon ..... E06B 9/42
2019/0106938 A1 * 4/2019 Foley ..... E06B 9/72
2019/0145163 A1 * 5/2019 Thomsen ..... E06B 9/174
2019/0145166 A1 * 5/2019 Campagna ..... E06B 9/72 160/310
2019/0162022 A1 * 5/2019 Geiger ..... E06B 9/50
2019/0226272 A1 * 7/2019 Frantz ..... D06F 39/14
2019/0277078 A1 * 9/2019 Baruco ..... E05F 15/686
2019/0284876 A1 * 9/2019 Colson ..... E06B 9/68
2019/0352964 A1 * 11/2019 Kasai ..... H02K 7/102

OTHER PUBLICATIONS

United States Patent and Trademark Office, "Final Office action," issued in connection with U.S. Appl. No. 15/193,810, dated Aug. 15, 2018, 9 pages.
United States Patent and Trademark Office, "Non-Final Office Action," issued in connection with U.S. Appl. No. 15/193,810, dated Dec. 4, 2018, 12 pages.
United States Patent and Trademark Office, "Final Office Action," issued in connection with U.S. Appl. No. 15/193,810, dated May 28, 2019, 8 pages.
United States Patent and Trademark Office, "Notice of Allowance," issued in connection with U.S. Appl. No. 15/193,810, dated Aug. 21, 2019, 5 pages.

* cited by examiner

END CAPS FOR ARCHITECTURAL COVERINGS

RELATED APPLICATION

This patent claims the benefit of U.S. Provisional Patent Application Ser. No. 62/410,342, filed on Oct. 19, 2016, under 35 U.S.C. § 119(e). U.S. Provisional Patent Application Ser. No. 62/410,342 is hereby incorporated by reference in its entirety.

FIELD OF THE DISCLOSURE

This disclosure relates generally to architectural coverings, and, more particularly, to end caps for architectural coverings.

BACKGROUND

Some architectural coverings include a motor assembly to control, for example, extension or retraction of the fabric or other shading material via a roller tube. The motor assembly may be operatively coupled to a power source via one or more cables. Some architectural coverings include a head rail having end caps for housing the roller tube and the motor assembly between the end caps.

In some architectural coverings, the power source may be positioned in different positions relative to the head rail and, thus, the end caps. Some such architectural coverings are pre-assembled with the cable(s) for coupling the motor assembly to the power source routed in a first configuration relative to a power source positioned in a first position with respect to the head rail. Manipulating the cable(s) to couple with a power source positioned in a different position than the first position can involve extensive disassembly of the architectural covering to access the cable(s) and can result in user interference with the shading material as the user attempt to access the cable(s). Some architectural coverings may require different end caps to accommodate different configurations of the cable(s).

BRIEF DESCRIPTION OF THE DRAWINGS

Implementations of end caps for architectural coverings constructed in accordance with various principles disclosed herein will be described with respect to the following drawings, which are not to be considered as limiting, but rather, illustrations of examples of manners of implementing principles of the disclosure. Many other implementations will occur to persons of ordinary skill in the art upon reading this disclosure.

Figure 1:
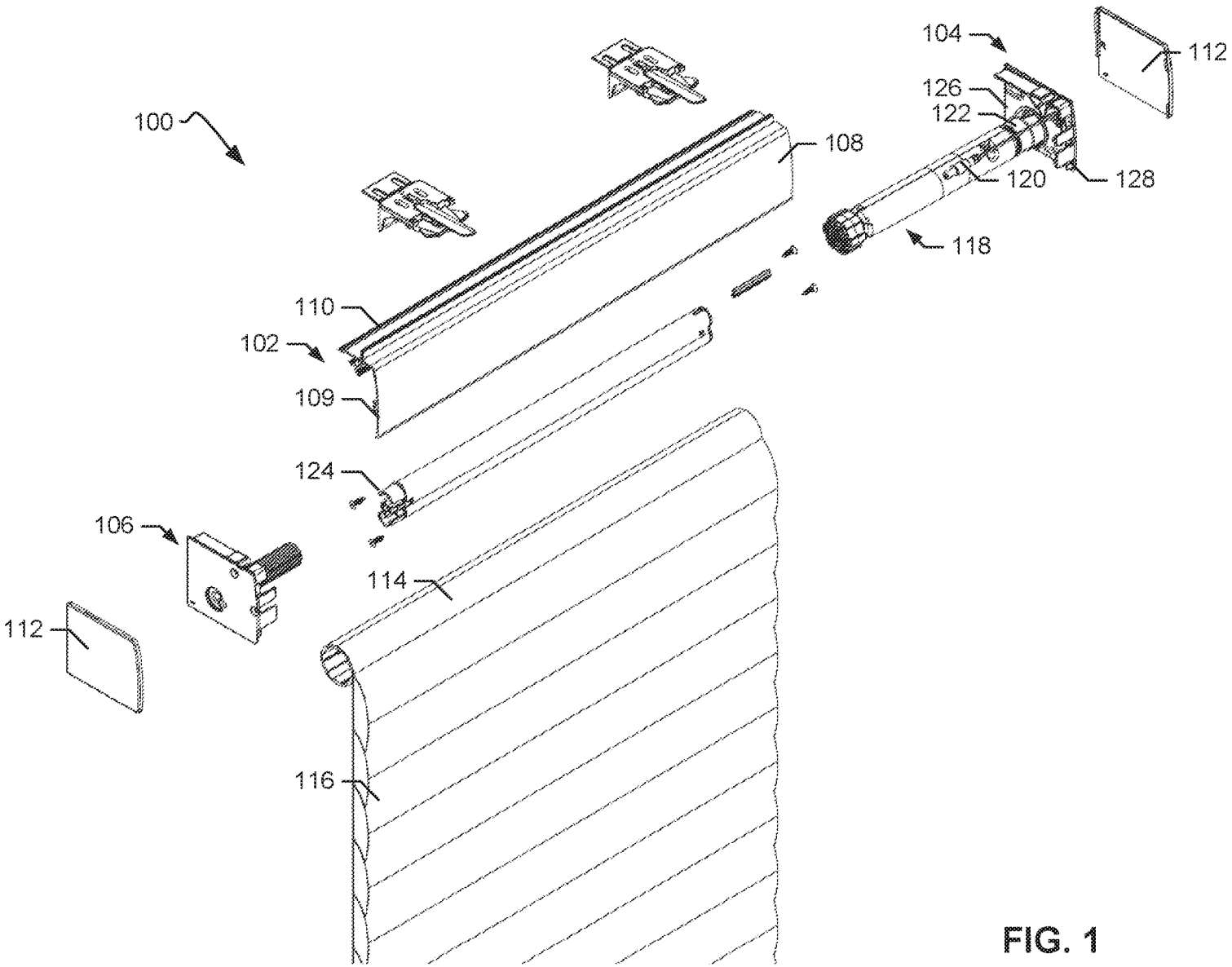
FIG. 1 is a partially exploded view of an example of an architectural covering including a head rail having an end cap in accordance with the teachings of this disclosure.

The figures are not necessarily to scale. Instead, to clarify multiple layers and regions, the thickness of the layers may be enlarged in the drawings. Wherever possible, the same reference numbers will be used throughout the drawing(s) and accompanying written description to refer to the same or like parts.

DETAILED DESCRIPTION

Disclosed herein are examples of end caps for architectural coverings which cover architectural structures such as openings (e.g., windows or doorways). An example architectural covering includes fabric or other shading material coupled to a roller tube, and a motor assembly for extending or retracting fabric or other shading material via the roller tube. The motor assembly operates via a power source such as a battery pack, a DC power supply, an AC electrical outlet, etc. The motor assembly is coupled to the power source via a cable (e.g., an electrical wire, a power cord, etc., hereinafter generally referred to as a "cable") that is coupled to and extends from the motor assembly. A head rail with two end caps may be provided to cover the motor assembly, the roller tube, and/or other components of the example architectural covering disposed between the two end caps.

In examples of architectural coverings disclosed herein, the power source for the motor assembly may be located in different positions relative to the head rail. For example, the power source can be disposed in an interior of the head rail proximate to a front, or room-facing portion of the head rail. In other examples, the power source is disposed on an outside surface of the head rail such as a rear surface of the head rail facing the architectural structure over which the architectural covering is installed. In other examples, the power source is spaced apart from the architectural covering. For example, the power source can be an electrical outlet disposed in a room in which the architectural structure is located. Accordingly, in some examples, a position of the cable of the motor assembly that connects the motor assembly to the power source may be adjusted based on the position of the power source relative to the head rail.

Example end caps disclosed herein facilitate routing or guiding of the cable from the motor assembly to the power source. Example end caps disclosed herein enable the cable to be selectively coupled to the end cap in (1) a first configuration for coupling to a power source disposed in a first position relative to the end cap, or (2) a second configuration for coupling to a power source disposed in a second position relative to the end cap. Example end caps disclosed herein include one or more cable-routing elements or structures (e.g., channels, apertures, grooves, and/or projections) for selectively routing (and, optionally, also securing) the cable in the first configuration or the second configuration while minimizing interference between the cable and other components of the example architectural coverings, such as the shading material. Example end caps enable a user to selectively route the cable in the first configuration or the second configuration without requiring the user to substantially disassemble the architectural covering and/or attempt to access the cable via an interior of the head rail. Rather, the user can readily manipulate the cable via example end caps disclosed herein without dismounting the architectural covering or, in some examples, without dismounting any part thereof. Thus, example end caps disclosed herein reduce user interference with the shading material, power source, etc. and facilitate installation of the architectural covering regardless of the position of the power source. Further, example end caps disclosed herein substantially eliminate the need for different end caps to accommodate different routing configurations of the cable, as some example end caps include cable-routing elements (e.g., channels, apertures, and/or projections) to route the cable in at least two configurations. The cable-routing elements guide the cable in the selected configuration corresponding to a position of the power source relative to the end cap.

Example end caps disclosed herein may provide for strain relief with respect to the cable and the motor assembly to which the cable is coupled. In some examples, the cable is manipulated (e.g., pulled) by a user to change a wire routing configuration of the cable at the end cap based on the location of the power supply. In other examples, the user manipulates (e.g., holds and/or pulls on) the cable to unplug the cable from, for example, a battery pack to replace one or more batteries. Example end caps disclosed herein may include a strain relief structure such as a hook to which a portion of the cable is coupled to prevent undue forces from being exerted on the motor assembly when the cable is manipulated or pulled. As the user manipulates the cable (e.g., by holding onto the cable and, in some examples, pulling on the cable), the cable may exert a force on or otherwise affect the motor assembly to which the cable is coupled. For example, as the user manipulates the cable, the cable may pull on a circuit board of the motor assembly, which may break the wires of the circuit board.

In other examples disclosed herein, the end cap provides a path for routing the cable for coupling to a power source in one wire routing configuration in instances in which a location of the power source does not vary. In such examples, the end cap provides for strain relief and routes the cable relative to the remainder of the head rail so the cable does not substantially interfere with other components of the head rail. In such examples, additional strain relief may be provided via a cable retainer. The cable retainer can be coupled to a portion of the head rail to provide strain relief with respect to the cable and the motor assembly to which the cable is coupled. Thus, in examples where a location of the power source does not vary, the end cap can substantially secure the cable in a wire routing configuration to manage the length of the cable relative to the head rail.

All apparatuses and methods discussed in this document are examples of apparatuses and/or methods implemented in accordance with one or more principles of this disclosure. These examples are not the only way to implement these principles but are merely examples. Thus, references to elements or structures or features in the drawings must be appreciated as references to examples of embodiments of the disclosure, and should not be understood as limiting the disclosure to the specific elements, structures, or features illustrated. Further, the names given to the specific elements, structures, or features should not be understood as the only names for the specific elements. Other examples of manners of implementing the disclosed principles will occur to a person of ordinary skill in the art upon reading this disclosure.

Turning now to the figures, FIG. 1 illustrates an exploded view of an example of an architectural covering 100 for covering an architectural feature or structure such as a window (not shown) or any other architectural feature or structure (herein "structure" for the sake of convenience without intent to limit). The illustrated architectural covering 100 includes head rail 102 having first end cap 104 and second end cap 106. When assembled, the illustrated head rail 102, first end cap 104, and second end cap 106 form at least a partial housing structure or covering for one or more components of the illustrated architectural covering 100. In some examples, cover 112 (e.g., a plate) is coupled to each of first and second end caps 104, 106 to provide for aesthetic covering of first and second end caps 104, 106. First end cap 104, second end cap 106, and cover 112 can be made of, for example, a plastic material.

When an architectural covering 100 as illustrated in FIG. 1 is installed over an architectural structure, first or outer portion 108 of head rail 102 faces away from the architectural structure (e.g., toward an interior of a room in which architectural covering 100 is installed) and second or inside front portion 109 is opposite outer portion 108. Head rail 102 includes third or rear portion 110 of head rail 102 facing toward the architectural structure (e.g., toward a window or a wall on which architectural covering 100 is installed).

The illustrated example of an architectural covering 100 includes shading material 116 coupled to roller tube 114. Roller tube 114 extends between first end cap 104 and second end cap 106 of head rail 102. A length of shading material 116 can be extended or retracted relative to the architectural structure via rotation of roller tube 114, which winds and unwinds shading material 116.

In example architectural covering 100 of FIG. 1, shading material 116 is wound or unwound about roller tube 114 by motor assembly 118 which is coupled to roller tube 114 to effect rotation of roller tube 114. Cable 120 extends from first end 122 of motor assembly 118, as will be further disclosed below. Cable 120 operatively couples motor assembly 118 to power source 124. Power source 124 can be, for example, a battery pack, a line power source, etc.

In the example of an architectural covering 100 illustrated in FIG. 1, power source 124 can be disposed inside head rail 102. For example, power source 124 can be disposed proximate to inside front portion 109 of head rail 102 between an inner surface of head rail 102 and roller tube 114 so that head rail 102 obscures the view of power source 124 from a person viewing architectural covering 100. In other examples, power source 124 is coupled to or disposed proximate to rear portion 110 of head rail 102. In some such examples, power source 124 is disposed outside of head rail 102 and, thus, is external to head rail 102 as compared to examples where power source 124 is disposed within head rail 102, such as proximate to inside front portion 109 of head rail 102. In other examples, power source 124 is spaced apart from architectural covering 100. For example, power source 124 can be mounted on a wall in a room in which architectural covering 100 is located. In examples where power source 124 is spaced apart from architectural covering 100 or is disposed proximate to rear portion 110 of head rail 102, cable 120 can be coupled to an extension power cord that is coupled to power source 124. The positioning of power source 124 relative to head rail 102 also affects a positioning of power source 124 to motor assembly 118. For example, power source 124 can be disposed closer to or farther from motor assembly 118 depending on a position of motor assembly 118 in head rail 102 and a position of power source 124 relative to inside front portion 109 or rear portion 110 of head rail 102.

In example architectural covering 100 of FIG. 1, first end 122 of motor assembly 118 is coupled to first end cap 104. A shape, size, etc. of first end cap 104 can differ from the example illustrated in FIG. 1. As illustrated in FIG. 1, first end cap 104 includes first surface 126 that faces roller tube 114. First end cap 104 includes second surface 128, or a surface facing away from roller tube 114 and to which cover 112 can be coupled. In example architectural covering 100 of FIG. 1, first end 122 of motor assembly 118 is coupled to first end cap 104 such that motor assembly 118 extends through first end cap 104 from first surface 126 to second surface 128.

Figure 2:
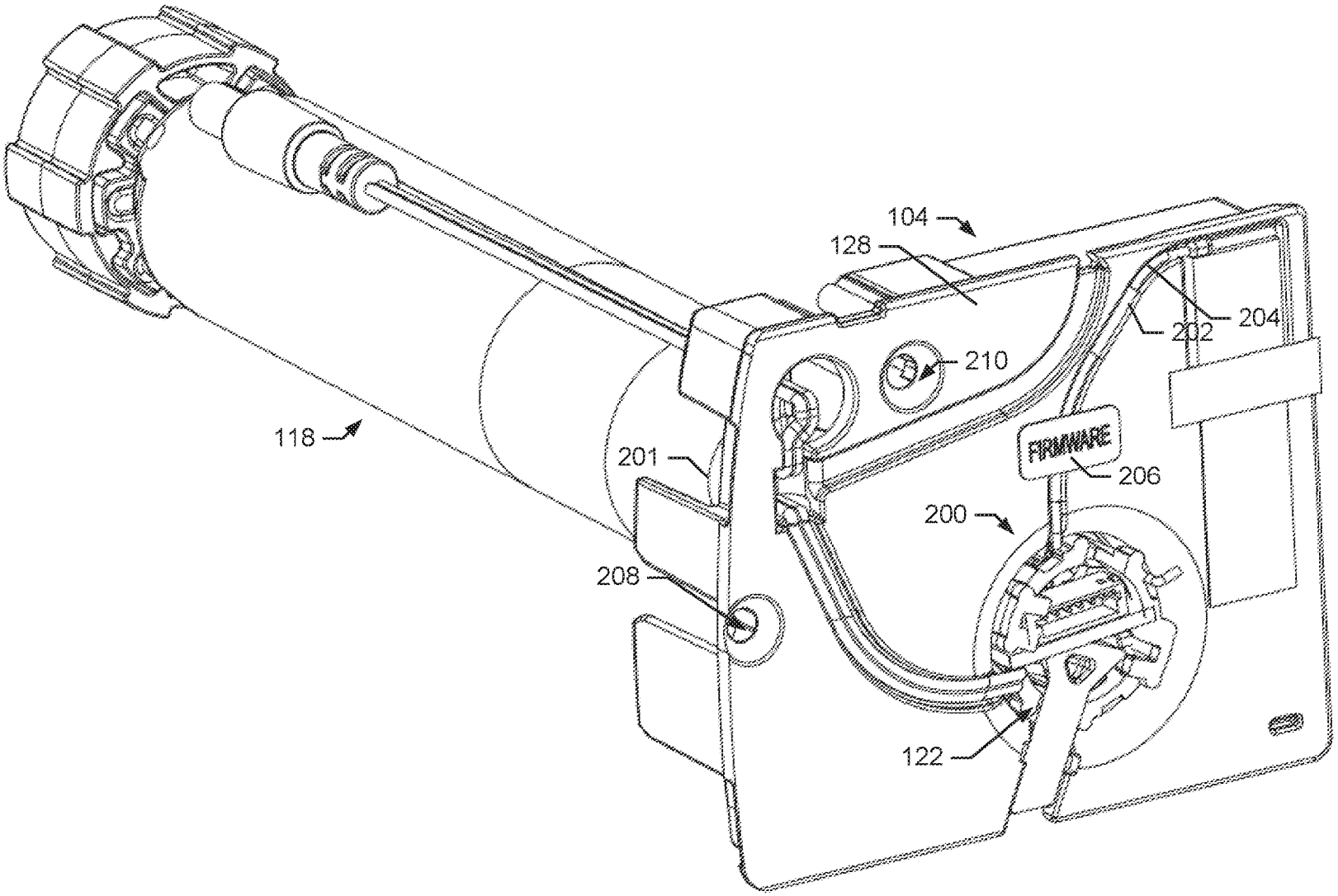
FIG. 2 is a left, front perspective view of an example of an end cap of the architectural covering of FIG. 1.

FIG. 2 illustrates a left, front perspective view of first end cap 104 of architectural covering 100 of FIG. 1 including motor assembly 118 coupled thereto. For illustrative purposes, cable 120, head rail 102, and roller tube 114 are not shown in FIG. 2. As illustrated in FIG. 2, second surface 128 of first end cap 104 includes motor mount 200. Motor mount 200 receives first end 122 of motor assembly 118 to couple motor assembly 118 to first end cap 104. Motor mount 200 includes a connector portion 201 to which motor assembly 118 is removably coupled (e.g., via a mechanical fastening). Connector portion 201 can include an opening to receive first end 122 of motor assembly 118 such that motor assembly 118 extends to second surface 128 of first end cap 104 via connector portion 201. Alternatively, motor assembly 118 can be coupled to motor mount 200 via other fastening means (e.g., a chemical fastener). Also, a size and shape of motor mount 200 can differ from the example illustrated in FIG. 2. Also, motor mount 200 can be located in a different position relative to second surface 128 of first end cap 104 than illustrated in FIG. 2 (e.g., centrally positioned on second surface 128 or positioned proximate to right, left, upper, and/or lower edges of first end cap 104). In some examples, a position of motor mount 200 can be based on a type of shading material 116 and an amount of space in the head rail 102 relative to the shading material 116 disposed about the roller tube 114.

Figure 3:
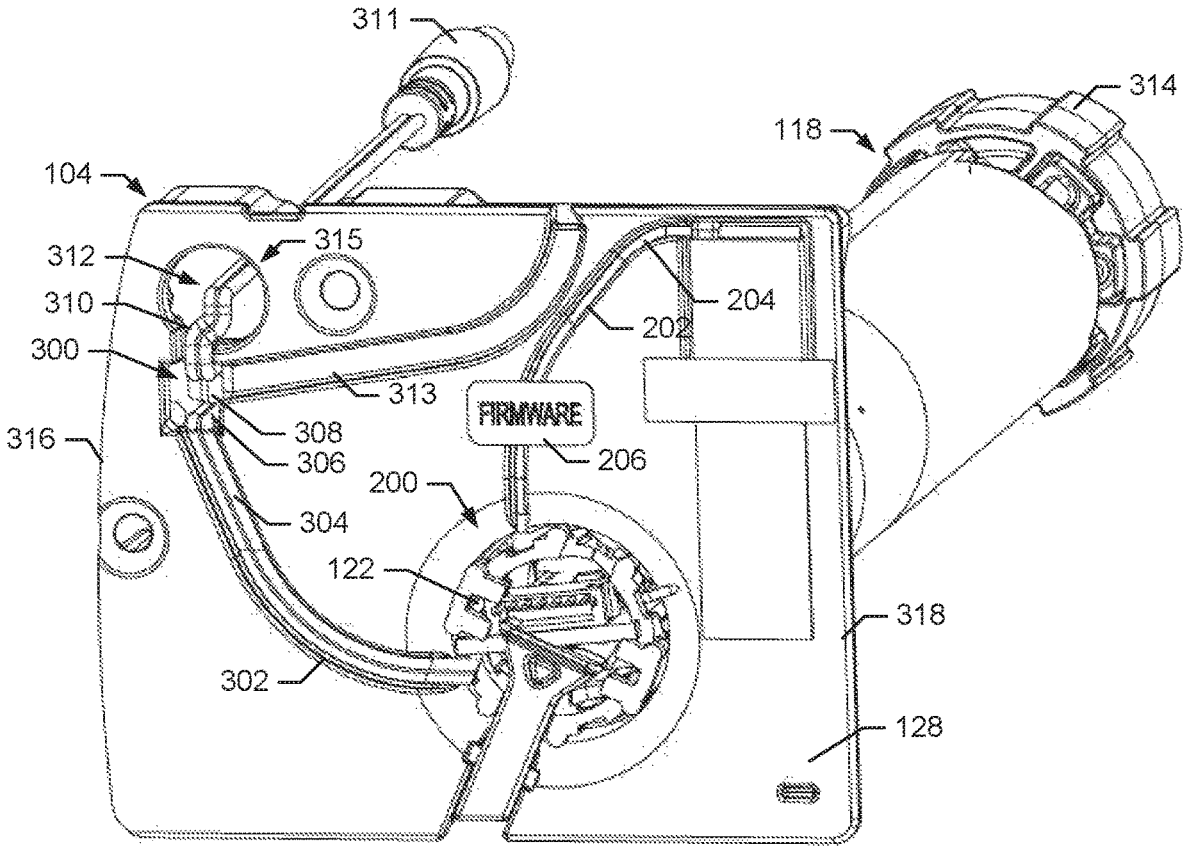
FIG. 3 is a front perspective view of the end cap of FIGS. 1 and 2 including a power cable coupled to the end cap in a first wire routing configuration.

In the example embodiment illustrated in FIGS. 2 and 3, second surface of first end cap 104 includes an antenna channel or track 202 defined therein. Antenna channel 202 can be formed in second surface 128 using, for example, a mold. A size, shape, curvature, etc. of antenna channel 202 can differ from the example illustrated in FIG. 2. In example architectural covering 100, antenna 204 is positioned in antenna channel 202. In some examples, label 206 is disposed on second surface 128 of first end cap 104 such that label 206 is at least partially disposed over antenna channel 202 and may be secured with a chemical fastener. Label 206 can include information about architectural covering 100 such as model number and/or information regarding motor assembly 118. Label 206 can also help to retain antenna 204 in antenna channel 202 such that antenna 204 does not protrude or substantially protrude from antenna channel 202. In some examples, additional labels 206 are disposed on first end cap 104.

As also shown in FIG. 2, first end cap 104 includes first cover connector 208 and second cover connector 210. First cover connector 208 and second cover connector 210 respectively permit connectors (e.g., screws, tabs) to couple cover 112 to second surface 128 of first end cap 104. In one embodiment, cover connectors 208 and 210 are apertures configured to receive a secondary connector to couple cover 112 to end cap 104. Other connectors known in the art or later developed may be used instead, such cover connectors not being critical. Second surface 128 of first end cap 104 can include additional or fewer cover connectors configured to permit coupling of cover 112 to first end cap 104 than illustrated in FIG. 2. In other examples, cover 112 is coupled to first end cap 104 using a chemical fastener.

In examples disclosed herein, an end cap of an architectural covering includes one or more features to facilitate routing of a cable along one or more paths or routes with respect to the end cap 104. For example, a surface of the end cap can include one or more features providing one or more different routes or paths along which the cable may extend from a motor assembly to a power source when the motor assembly is removably coupled to the end cap. In some examples, the end cap includes a cable-directing element (e.g., a post, a hook) to engage at least a portion of the cable and to affect the direction in which the cable extends and/or to provide strain relief with respect to the cable and the motor assembly. For example, if a force is exerted on the cable, the cable-directing element substantially prevents the force from being transferred to the motor assembly or to the power source.

FIG. 3 is a front perspective view of first end cap 104 of FIGS. 1 and 2 including cable 120 of motor assembly 118 positioned with respect to first end cap 104. For illustrative purposes, head rail 102 and roller tube 114 are not shown in FIG. 3. As will be disclosed below, example first end cap 104 facilitates routing of cable 120 from motor assembly 118 to power source 124 via one or more cable-routing structures. In the illustrated example of FIG. 3, second surface 128 of first end cap 104 includes shared cable-routing element 302, which can include a channel or track. Shared cable-routing element 302 guides at least a portion of cable 120 when cable 120 is routed via first end cap 104 for coupling with power source 124 when power source 124 is in a first position relative to first end cap 104 or a second position relative to first end cap 104. In the illustrated example of FIG. 3, shared cable-routing element 302 is formed on second surface 128 adjacent to motor mount 200. In other examples, second surface 128 of first end cap 104 does not include shared cable-routing element 302.

As illustrated in FIG. 3, second surface 128 of first end cap 104 includes cable transition element 300 provided (e.g., defined) therein. In the example of FIG. 2, cable transition element 300 is an aperture. Cable transition element 300 guides at least a portion of cable 120 when cable 120 is routed via first end cap 104. In some examples, shared cable-routing element 302 extends from motor mount 200 to cable transition element 300 (e.g., an aperture). For example, first end cap 104 of FIG. 3 can be divided into regions and shared cable-routing element 302 extends from motor mount 200 to cable transition element 300 located in a first (e.g., an upper) region of front or second surface 128 of first end cap 104. The positioning, shape, size, etc. of cable transition element 300 and/or shared cable-routing element 302 can differ from the examples illustrated in FIG. 3.

As illustrated in FIG. 3, cable 120 extends from first end 122 of motor assembly 118. For reference purposes with respect to the illustrated example of the figures, cable 120 can be considered to include multiple portions that are routed via the first end cap 104. For example, as illustrated in FIG. 3, cable 120 includes first portion 304, or a portion of cable 120 proximate to first end 122 of motor assembly 118. First portion 304 of cable 120 is disposed in (e.g., inserted into) shared cable-routing element 302. In some examples, one or more labels (not shown) are at least partially disposed (e.g., secured such as with a chemical fastener) over shared cable-routing element 302 to help retain first portion 304 of cable 120 in shared cable-routing element 302, as substantially disclosed above in connection with label 206 and antenna channel 202.

In example first end cap 104 illustrated in FIGS. 1-3, first portion 304 of cable 120 is routed from first end 122 of motor assembly 118 through shared cable-routing element 302 to extend to power source 124 positioned opposite second surface 128 of first end cap 104, such as proximate to inside front portion 109 of head rail 102. Transition portion 306 of cable 120 extends through cable transition element 300 (e.g., an aperture). In the illustrated example of FIG. 3, transition portion 306 includes or a portion of cable 120 between first portion 304 of cable 120 disposed in shared cable-routing element 302 and a remainder of cable 120 including pigtail 311, or second portion 310 of cable 120.

First end cap 104 includes cable-directing element 308 (e.g., a hook, a post) that engages (e.g., retains, holds, or guides) transition portion 306 of cable 120. For example, cable-directing element 308 can be a hook that retains transition portion 306 of cable 120 when transition portion 306 of cable 120 is wrapped around cable-directing element 308. Transition portion 306 of cable 120 is engaged by cable-directing element 308 that is adjacent to first surface 126 of first end cap 104, as will be further described below in connection with FIGS. 4 and 5. In the illustrated example of FIG. 3, cable-directing element 308 is accessed from second surface 128 of first end cap 104 via cable transition element 300. In some examples, cable-directing element 308 is located on first surface 126 of first end cap 104 so as to enable cover 112 to be coupled to second surface 128 of first end cap 104 (e.g., such that cover 112 is substantially flush against second surface 128 of first end cap 104). Cable transition element 300 enables a user to readily access transition portion 306 of cable 120 to, for example, replace cable 120. In other examples, cable-directing element 308 is disposed on second surface 128 of first end cap 104. In such examples, first end cap 104 may not include cable transition element 300. A position, size, shape, etc. of cable-directing element 308 can be different from the example shown in FIG. 3. In the illustrated example, transition portion 306 of cable 120 is looped around cable-directing element 308 such that second portion 310 of cable 120, or a remainder of cable 120 that is not disposed in shared cable-routing element 302 or engaged with cable-directing element 308, may extend through cable transition element 300 (e.g., an aperture). Cable-directing element 308 engages transition portion 306 of cable 120 such that second portion 310 may be selectively routed in different directions or configurations via routes or paths provided by first end cap 104. Thus, cable-directing element 308 (and, in some examples, cable transition element 300) serves as a cable direction-changing element for routing cable 120 in different configurations.

Second portion 310 of cable 120 can be routed by first end cap 104 in a first wire routing configuration (shown in FIG. 3) or a second wire routing configuration (shown in FIG. 6) based on the position of power source 124 relative to first end cap 104. When first end cap 104 is coupled to head rail 102 of example architectural covering 100 of FIG. 1, first or front edge 316 of first end cap 104 is disposed proximate to inside front portion 109 of head rail 102. In examples where power source 124 is disposed proximate to inside front portion 109 of head rail 102 (e.g., a first position relative to first end cap 104), first end cap 104 provides first wire routing configuration 315 proximate to front edge 316 of first end cap 104 to enable second portion 310 of cable 120 to be positioned proximate to inside front portion 109 of head rail 102 for coupling pigtail 311 or any other type of wiring connection to power source 124.

FIG. 3 illustrates second portion 310 of cable 120 in first wire routing configuration 315 for coupling cable 120 to power source 124 when power source 124 is disposed proximate to or coupled to inside front portion 109 of head rail 102. As illustrated in FIG. 3, in first wire routing configuration 315, second portion 310 of cable 120 is routed from cable transition element 300 (e.g., an aperture) to first cable-routing element 312 provided (e.g., defined) in a first portion of second surface 128 of first end cap 104 (e.g., a portion proximate to front edge 316). In the example of FIG. 3, first cable-routing element 312 is an aperture. However, first cable-routing element 312 could include other structures, such as a groove accessed from an edge of first end cap 104 or a channel. Second portion 310 extends through first cable-routing aperture 312 toward power source 124 when power source 124 is disposed in head rail 102 proximate to inside front portion 109 of head rail 102. When second portion 310 of cable 120 is routed in first wire routing configuration 315, first cable-routing element 312 functions as a cable guide, or a structure that guides at least a portion of cable 120 from second surface 128 of first end cap 104 to first surface 126 of first end cap 104 for coupling with power source 124 disposed proximate to first surface 126 of first end cap 104. As illustrated in FIG. 3, first cable-routing element 312 is provided (e.g., defined) in second surface 128 of first end cap 104 proximate to front edge 316. Put another way, when example first end cap 104 of FIG. 3 is divided into regions, first cable-routing element 312 is positioned in a region of second surface 128 of first end cap 104 proximate to cable transition element 300. A position, size, etc. of first cable-routing element 312 can differ from the example shown in FIG. 3 (e.g., first cable-routing element 312 can be proximate to motor mount 200 or a bottom edge of first end cap 104). Thus, when second portion 310 of cable 120 is routed via first cable-routing element 312 in first wire routing configuration 315, second portion 310 of cable 120 is disposed proximate to inside front portion 109 of head rail 102. In first wire routing configuration 315, pigtail 311 of cable 120 can be coupled to power source 124 in a first position relative to first end cap 104, or a position in which power source 124 is disposed inside head rail 102 (e.g., adjacent roller tube 114).

Figure 4:
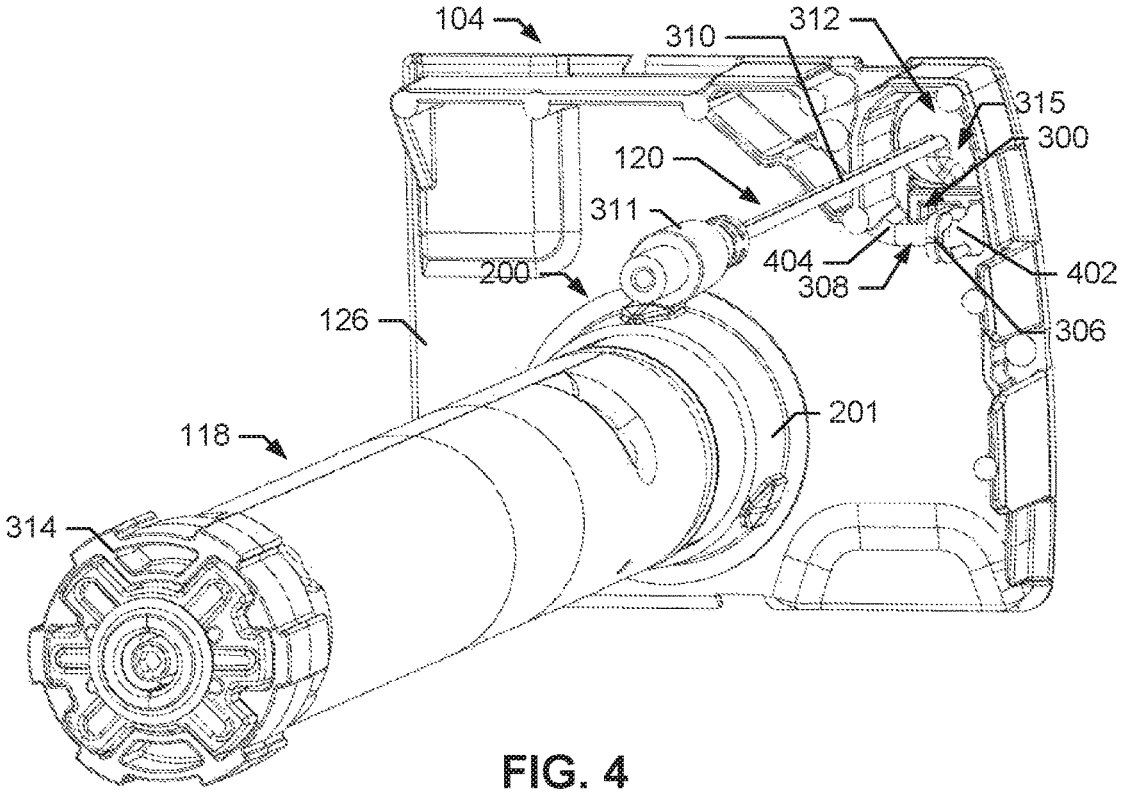
FIG. 4 is a left, rear perspective view of the end cap of FIGS. 1-3.
Figure 5:
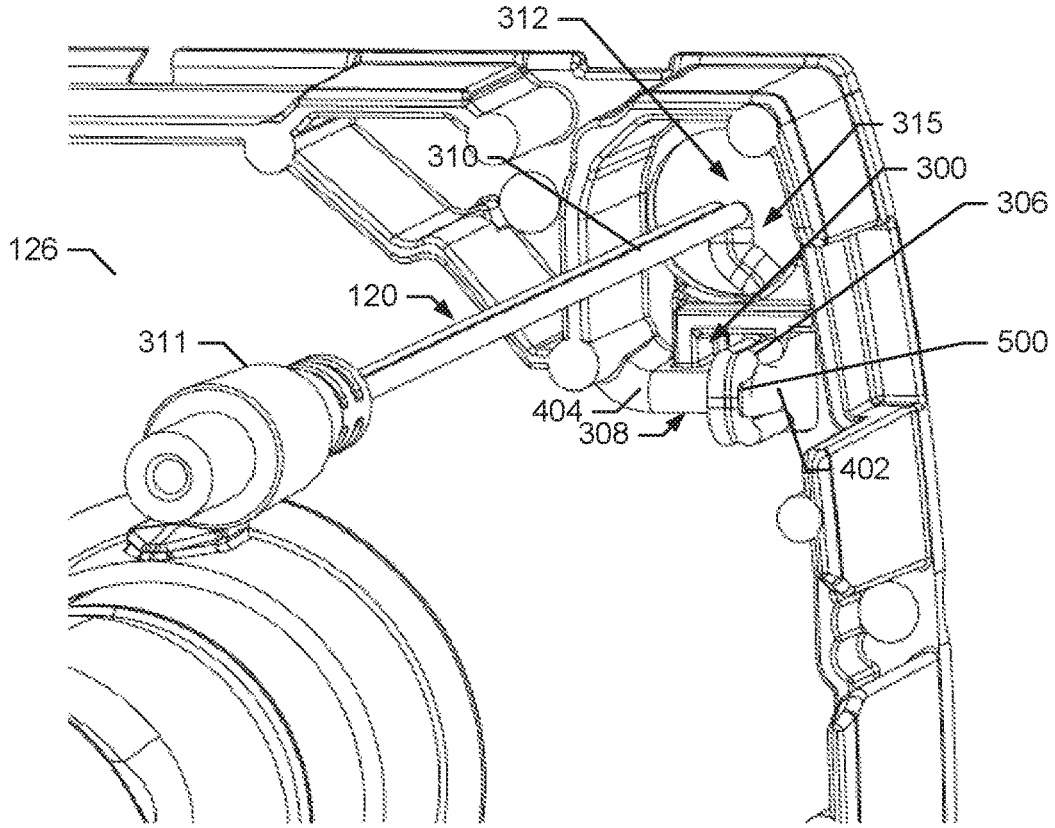
FIG. 5 is a partial, left rear perspective view of the end cap of FIGS. 1-4.

FIG. 4 illustrates a left, rear perspective view of first end cap 104 of FIGS. 1-3 including first surface 126 of first end cap 104 and cable 120 routed in first wire routing configuration 315. FIG. 5 is a partial left, rear perspective view of first surface 126 of first end cap 104 of FIG. 1-4 including the cable 120 routed in first wire routing configuration 315. FIGS. 4 and 5 illustrate an example of cable-directing element 308 and the engagement between cable-directing element 308 and transition portion 306 of cable 120. For illustrative purposes, head rail 102 and roller tube 114 are not shown in FIGS. 4 and 5. As illustrated in FIGS. 4 and 5, transition portion 306 of cable 120 extends from second surface 128 into cable transition element 300 (e.g., an aperture) and toward first surface 126, wraps around cable-directing element 308, and extends out of cable transition element 300 toward second surface 128 of first end cap 104. Thus, cable 120 changes direction via cable-directing element 308 in that cable 120 extends in and out of cable transition element 300 as a result of engagement of transition portion 306 of cable 120 with cable-directing element 308. An example embodiment of cable-directing element 308 includes a hook having protrusion 402 and post 404, as illustrated in FIGS. 4 and 5.

In some examples, when transition portion 306 of cable 120 extends through cable transition element 300, second portion 310 of cable 120 is hooked over protrusion 402 and engages post 404 (e.g., is held by protrusion 402 against post 404). In the illustrated example, cable-directing element 308 is substantially L-shaped with protrusion 402 extending from an end of post 404 such that transition portion 306 rests against protrusion 402 and, thus, does not slide off of post 404. To wrap transition portion 306 of cable 120 around post 404, transition portion 306 of cable 120 can be inserted (e.g., by a user or a manufacturer) through cable transition element 300 and slid over protrusion 402. In some examples, a user may bend transition portion 306 of cable 120 into a substantially U-shaped configuration prior to inserting transition portion 306 through cable transition element 300. U-shaped transition portion 306 can be inserted into cable transition element 300 and hooked over protrusion 402 such that U-shaped transition portion 306 substantially wraps around post 404. In some examples, as shown in FIG. 5, protrusion 402 includes chamfered or angled face 500 to guide the user in hooking transition portion 306 of cable 120 over protrusion 402. Transition portion 306 can be engaged by cable-directing element 308 in other ways than those shown in FIGS. 3-5 to redirect transition portion 306 relative to second surface 128 of first end cap 104. For example, a user can insert transition portion 306 of cable 120 into cable transition element 300 (e.g., toward first surface 126 of first end cap 104) and around post 404. In such examples, the user can pull second portion 310 of cable 120 out of cable transition element 300 to direct second portion 310 of cable 120 out of cable transition element 300 toward second surface 128 of first end cap 104 for routing second portion 310 of cable 120 in first wire routing configuration 315 or the second wire routing configuration (shown in FIG. 6) to couple pigtail 311 of cable 120 with power source 124. In some such examples, cable-directing element 308 does not include protrusion 402. In other examples, cable-directing element 308 includes two or more protrusions 402. In other examples, cable-directing element 308 includes a first slot (e.g., an opening having dimensions to receive cable 120) into which transition portion 306 of cable 120 is inserted (e.g., toward first surface 126 of first end cap 104) and a second slot through which second portion 310 of cable 120 is pulled out of (e.g., toward second surface 128 of first end cap 104).

In some examples, cable-directing element 308 provides strain relief with respect to cable 120 and motor assembly 118 when second portion 310 of cable 120 is coupled to power source 124 or is manipulated by a user during coupling or uncoupling of second portion 310 of cable 120 and power source 124. In such examples, cable-directing element 308 also holds transition portion 306 of cable 120 when second portion 310 of cable 120 is coupled to power source 124. For example, when a user couples cable 120 to power source 124 via pigtail 311, the user may manipulate (e.g., pull on) second portion 310 of cable 120. As another example, if power source 124 includes a battery and the battery needs to be replaced, the user may manipulate (e.g., pull on) second portion 310 of cable 120 to disconnect cable 120 from power source 124 and reconnect cable 120 to power source 124 after replacing the battery. When the user manipulates second portion 310 of cable 120, absent cable-directing element 308 or other strain relief, forces could be exerted on motor assembly 118 where cable 120 couples to motor assembly 118 and/or at power source 124 where pigtail 311 of cable 120 couples to power source 124. Excessive forces exerted on cable 120 and/or motor assembly 118 could cause wear or damage to motor assembly 118 (e.g., to a circuit board of motor assembly 118 to which cable 120 is coupled). Forces exerted on cable 120 could also affect a connection between motor assembly 118 and cable 120 if cable-directing element 308 or other strain relief is not utilized. For example, cable 120 could become disconnected from motor assembly 118.

The positioning of transition portion 306 of cable 120 with respect to cable-directing element 308 as illustrated in FIGS. 3-5 substantially reduces the forces exerted on motor assembly 118 when second portion 310 of cable 120 is manipulated by the user. For example, when a user pulls second portion 310 of cable 120, cable 120 does not pull (or is substantially limited from pulling) on motor assembly 118 due to the engagement of transition portion 306 of cable 120 with cable-directing element 308. Cable-directing element 308 holds transition portion 306 of cable 120 such that the force on second portion 310 of cable 120 does not result in a force being exerted on or transferred to motor assembly 118 or substantially reduces a force exerted on or transferred to motor assembly 118. Thus, first end cap 104 substantially relieves forces exerted on motor assembly 118 when the user manipulates cable 120. In some examples, first end cap 104 provides for integrated strain relief via cable-directing element 308. In such examples, cable-directing element 308 holds transition portion 306 and allows flexibility in positioning second portion 310 of cable 120 relative to power source 124 while minimizing forces exerted on motor assembly 118 and/or cable 120.

As disclosed above, first wire routing configuration 315 of cable 120 with respect to first end cap 104 enables cable 120 to be coupled to power source 124 disposed in a first position relative to first end cap 104, such as proximate to front edge 316 of first end cap 104 or, when first end cap 104 is coupled to head rail 102, proximate to inside front portion 109 of example head rail 102 of FIG. 1. As also disclosed above, in other examples, power source 124 is disposed in a second position relative to first end cap 104, such as proximate to rear edge 318 of first end cap 104 or, when first end cap 104 is coupled to head rail 102, proximate to rear portion 110 of head rail 102 of FIG. 1. In some such examples, power source 124 is proximate to rear portion 110 of head rail 102 (e.g., coupled to an inside or outside surface of rear portion 110). In other such examples, power source 124 is spaced apart from architectural covering 100 (e.g., power source 124 is mounted to a wall) and it may be preferable to position pigtail 311 toward rear portion 110 of head rail 102 for coupling an extension cord to pigtail 311 without causing interference between, for example, the extension cord and shading material 116. In such examples, cable 120 routed via first end cap 104 in the second wire routing configuration such that second portion 310 of cable 120 is disposed proximate to rear portion 110 of head rail 102 and, thus, power source 124. As illustrated in FIG. 3, second or rear edge 318 of first end cap 104 is disposed proximate to rear portion 110 of head rail 102. First end cap 104 includes second cable-routing element 313 formed in a second portion or region of first end cap 104. In the illustrated examples, second cable-routing element 313 is a channel or track. Second cable-routing element 313 can include other structures, such as an aperture. In the illustrated examples, at least a portion of second cable-routing element 313 is proximate to rear edge 318 of first end cap 104. For example, as illustrated in FIG. 3, an end of second cable-routing element 313 distal to first cable-routing element 312 is proximate to rear edge 318 of first end cap 104. Second cable-routing element 313 enables second portion 310 of cable 120 to be routed proximate to rear portion 110 of head rail 102 for coupling pigtail 311 to power source 124 disposed in a second position relative to first end cap 104 (e.g., proximate to rear edge 318 of first end cap 104).

Figure 6:
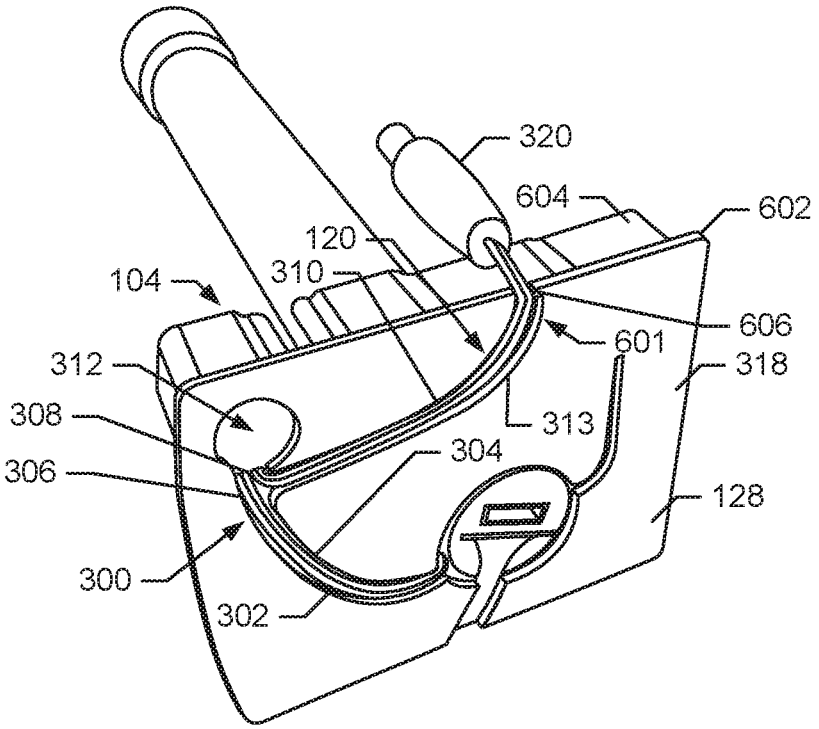
FIG. 6 is a left, front perspective view of the end cap of FIGS. 1-5 including the power cable of FIG. 3 coupled to the end cap in a second wire routing configuration.

FIG. 6 illustrates a left, front perspective view of first end cap 104 of FIGS. 1-5 including cable 120 routed in second wire routing configuration 601. For illustrative purposes, head rail 102 and roller tube 114 are not shown in FIG. 6. As illustrated in FIG. 6, first portion 304 of cable 120 is disposed in shared cable-routing element 302 of first end cap 104. Cable-directing element 308 engages transition portion 306 of cable 120 as substantially disclosed above in connection with FIGS. 3-5.

In the example of FIG. 6, second portion 310 of cable 120, or a portion that is not engaged with cable-directing element 308, extends from cable transition element 300 (e.g., an aperture) and is guided by second cable-routing element 313 (e.g., a channel) formed in second surface 128 of first end cap 104. Thus, second cable-routing element 313 is a cable receiver, or a structure that routes at least a portion of cable 120, when second portion 310 of cable is routed in second wire routing configuration 601. Second cable-routing element 313 routes second portion 310 of cable 120 toward a different region of first end cap 104 than first cable-routing element 312. In the illustrated example of FIG. 6, second cable-routing element 313 routes second portion 310 of cable 120 toward rear edge 318 of first end cap 104, or the edge is disposed proximate to rear portion 110 of head rail 102 when first end cap 104 is coupled to head rail 102. As illustrated in FIG. 6, second cable-routing element 313 extends toward third or upper edge 602 of first end cap 104. Thus, in the illustrated example, second cable-routing element 313 routes second portion 310 of cable 120 toward rear (and, in some examples, upper) portion 110 of head rail 102 for connection with power source 124 when power source 124 is disposed proximate to rear portion 110 or for connection with an extension cord in examples where power source 124 is an electrical wall outlet (and it is desirable for cable 120 to extend towards the back of head rail 102). Second cable-routing element 313 serves as an external power connection channel. Also, the formation of second cable-routing element 313 in second surface 128 helps to reduce interference between cable 120 and shading material 116 as compared if cable 120 was routed to rear portion 110 of head rail 102 via first surface 126 of first end cap 104 or an interior of head rail 102. Second cable-routing element 313 holds cable 120 to prevent interference between, for example, cable 120 and shading material 116, motor assembly 118, antenna 204, etc. A size, length, curvature, position, etc. of second cable-routing element 313 can differ from the example illustrated in FIG. 6.

When second portion 310 of cable 120 is positioned in second cable-routing element 313, first end cap 104 enables a remainder of cable 120 including pigtail 311 to pass from second surface 128 of first end cap 104 to first surface 126 of first end cap 104 for coupling with power source 124. In some examples, first end cap 104 includes a third cable-routing element 606 formed in an edge of first end cap 104, such as upper edge 602 of first end cap 104. In the example of FIG. 6, third cable-routing element 606 is a groove. In the illustrated example, third cable-routing element 606 allows pigtail 311 to pass from second surface 128 to first surface 126 while being deep enough to accommodate cover 112 to be coupled to first end cap 104 (e.g., for aesthetic purposes) while second portion 310 of cable 120 is positioned in groove or third cable-routing element 606. Third cable-routing element 606 can include other structures than a groove. In some examples, third cable-routing element 606 includes an aperture through which pigtail 311 passes.

In the example illustrated in FIG. 6, first end cap 104 may include a ledge 604 formed in a third portion of first end cap 104 proximate to upper edge 602. Ledge 604 can be formed from a sidewall of first end cap 104 including upper edge 602 of first end cap 104. In example first end cap 104, upper edge 602 includes third cable-routing element 606 (e.g., a groove). In some examples, a portion of third cable-routing element 606 is formed in ledge 604. A remainder of second portion 310 of cable 120, including pigtail 311, not disposed in second cable-routing element 313 passes through third cable-routing element 606. Third cable-routing element 606 directs second portion 310 of cable 120 including pigtail 311 away from shading material 116 and roller tube 114 to substantially prevent static electricity build-up, which can harm electrical components of architectural covering 100, such as motor assembly 118. Third cable-routing element 606 can be formed in upper edge 602 of first end cap 104 in a different position than illustrated in FIG. 6. Also, third cable-routing element 606 can have a different size and/or shape than illustrated in FIG. 6. For example, third cable-routing element 606 could be an aperture formed in second surface 128 of first end cap 104 (e.g., below upper edge 602). In some examples a size of third cable-routing element 606 is based on a diameter of cable 120. In other examples, second portion 310 of cable 120 does not pass through third cable-routing element 606 if a diameter of cable 120 is substantially larger than third cable-routing element 606. In other examples, first end cap 104 does not include third cable-routing element 606.

As illustrated in FIG. 6, when second portion 310 of cable 120 is in second wire routing configuration 601, transition portion 306 of cable 120 is directed (e.g., held) by cable-directing element 308. In some examples, cable-directing element 308 provides for strain relief relative to motor assembly 118 when second portion 310 of cable 120 is in second wire routing configuration 601. For example, a user may pull on cable 120 when second portion 310 is in second wire routing configuration 601 to couple pigtail 311 to an extension power cord. Cable-directing element 308 prevents or substantially reduces the pulling forces exerted on motor assembly 118 that are generated due to the pulling of second portion 310 of cable 120. Cable-directing element 308 can also substantially prevent forces from being transferred to power source 124 when cable 120 is coupled to power source 124.

Although FIGS. 3-6 illustrate first end cap 104 including cable-directing element 308, in some examples, first end cap 104 does not include cable-directing element 308. Rather, strain relief may be provided by first end cap 104 via tortuous wire path, or a routing of cable 120 that includes twists, turns, bends, etc. at first end cap 104 (e.g., via one or more channels). A tortuous wire path can substantially reduce a transfer of force from cable 120 to motor assembly 118 and/or power source 124 as compared to examples in which cable 120 is disposed in a substantially straight configuration.

Thus, example first end cap 104 provides for selective routing of cable 120 to couple cable 120 to power source 124 based on the positioning of power source 124 relative to first end cap 104. Further, example first end cap 104 of FIGS. 1-6 may provide for integrated strain relief with respect to strain placed on motor assembly 118 as a result of the coupling of cable 120 to motor assembly 118 and pulling forces exerted on cable 120 during operation and/or adjustment by a user. In first wire routing configuration 315, first cable-routing element 312 serves as a first cable receiver for routing second portion 310 of cable 120. In second wire routing configuration 601, second cable-routing element 313 serves as a second cable receiver for routing second portion 310 of cable 120. Formation of antenna channel 202, shared cable-routing element 302, and, in the illustrated examples, second cable-routing element 313 (e.g., a channel) in second surface 128 of first end cap 104 facing away from roller tube 114 substantially reduces the likelihood of interference (e.g., tangling) of cable 120 and/or antenna 204 and shading material 116 of example architectural covering 100 of FIG. 1 and facilitates coupling of cover 112 to second surface 128 of first end cap 104 by holding cable 120 substantially flat, preventing twisting of the cable, etc. In addition, the routing configurations provided by first end cap 104 ensure consistent positioning of cable 120 in the different routing configurations.

Further, the routing of cable 120 via first end cap 104 facilitates of ease of use by the user with respect to changing the configuration of cable 120 when first end cap 104 is coupled to architectural covering 100. For example, if cable 120 were routed inside head rail 102, a user may find it difficult to manipulate cable 120 to move cable 120 from inside front portion 109 of head rail 102 to rear portion 110 of head rail 102 due to other components disposed in head rail 102 in a confined space, such as roller tube 114, shading material 116, power source 124, etc. Example first end cap 104 disclosed herein allows the user to remove cover 112 and manipulate cable 120 in first wire routing configuration 315 or second wire routing configuration 601 without having to reach inside head rail 102. Thus, example first end cap 104 substantially reduces user interference with components of architectural covering 100 disposed inside head rail 102.

Figure 7:
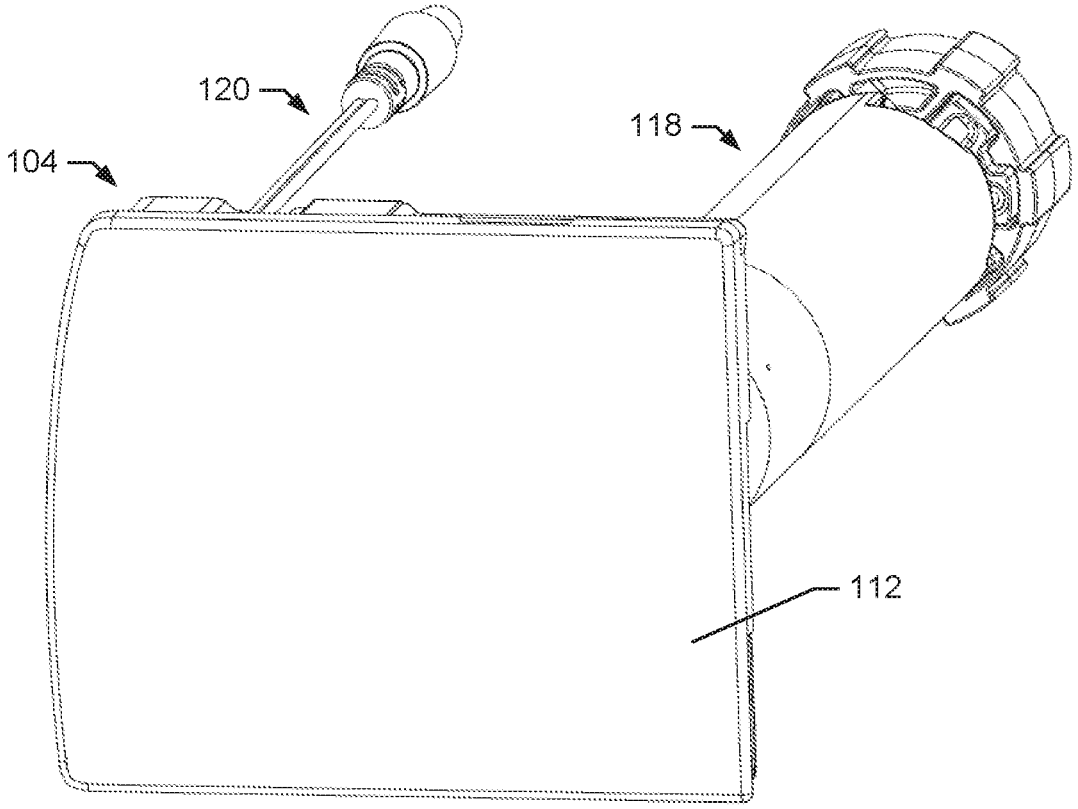
FIG. 7 is a front perspective view of the end cap of FIGS. 1-6 including a plate coupled thereto.

First wire routing configuration 315 via first cable-routing element 312 (e.g., an aperture) shown in FIGS. 3-5 and second wire routing configuration 601 via second cable-routing element 313 (e.g., a channel) shown in FIG. 6 are examples for illustrative purposes. In some examples, cable 120 is routed in first wire routing configuration 315 via a channel proximate to front edge 316 of end cap 104 in addition to or as an alternative to passing through first cable-routing element 312. In other examples, cable 120 is routed in second wire routing configuration 601 via an aperture proximate to rear edge 318 and/or upper edge 602 of first end cap 104 in addition to or as an alternative to passing through second cable-routing channel 313. Also, a position of first cable-routing element 312 and/or second cable-routing element 313 relative to second surface 128 of first end cap 104 can differ from the examples shown in the figures. Although examples disclosed herein are discussed in connection with first wire routing configuration 315 and second wire routing configuration 601, first end cap 104 could enable additional wire routing configurations. FIG. 7 illustrates a front perspective view of first end cap 104 having cover 112 of FIG. 1 removably coupled thereto. Cover 112 can be removably coupled to first end cap 104 via one or more mechanical fasteners and first and second cover connectors 208, 210, as disclosed above in connection with FIG. 2. In other examples, cover 112 is removably coupled to first end cap 104 via an interference fit between cover 112 and first end cap 104. As illustrated in FIG. 7, cover 112 substantially covers second surface 128 of first end cap 104. Cover 112 protects motor assembly 118 and cable 120 from external influences such as dust and/or unintended access (e.g., by a child). In some examples, cover 112 helps to secure antenna 204 in antenna channel 202 and/or cable 120 in shared cable-routing element 302 and/or second cable-routing element 313 (e.g., in examples where shared cable-routing element 302 and/or second cable-routing element 313 include channels). Cover 112 also serves an aesthetic function with respect to covering motor assembly 118, cable 120, motor mount 200, cable transition element 300, first cable-routing element 312, second cable-routing element 313 of first end cap 104, etc. Cover 112 can be coupled to first end cap 104 via, for example, tabs, screws, a chemical fastener, etc. Cover 112 can be removed from first end cap 104 (e.g., by a user) to access motor assembly 118 and/or cable 120.

Figure 8:
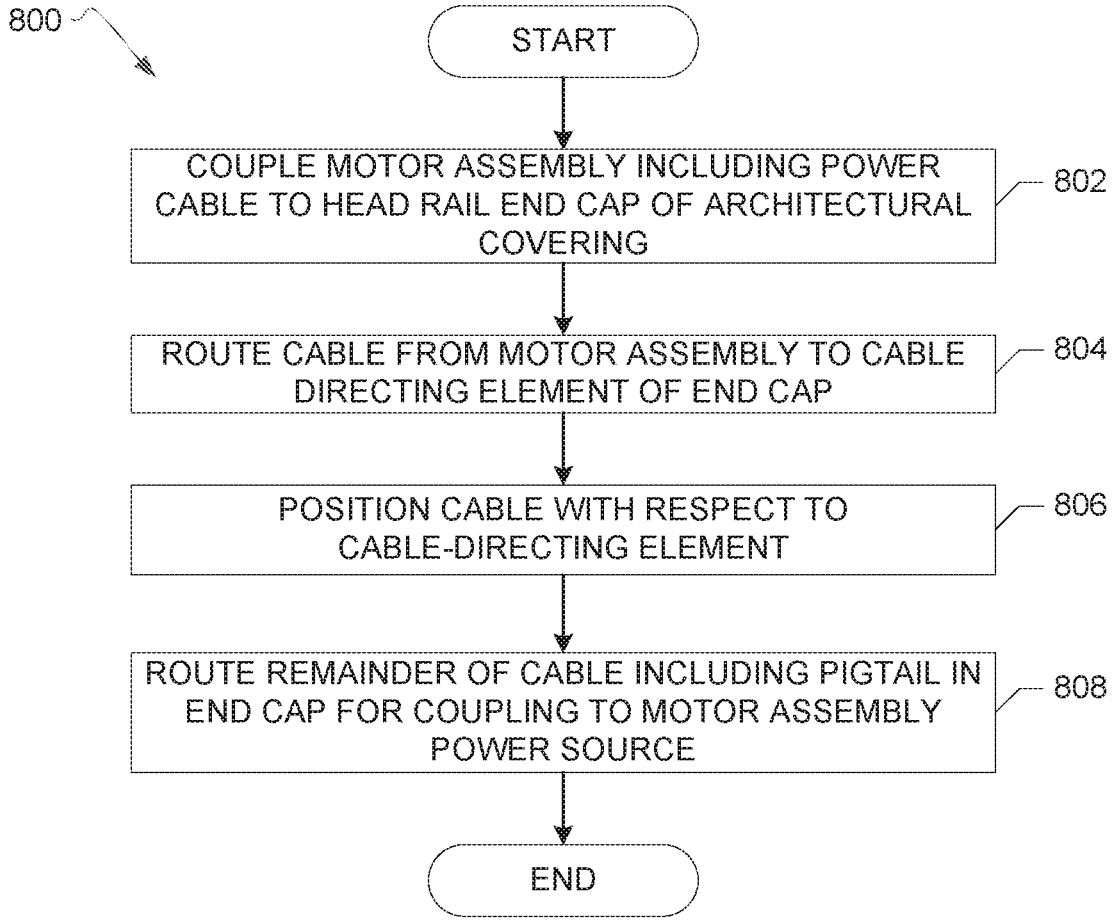
FIG. 8 is a flowchart representative of a process for coupling an example motor assembly including a power cable to an example end cap of a head rail of an architectural covering in accordance with the teachings of this disclosure.

FIG. 8 is a flowchart illustrating example method 800 for managing a power cable via an example end cap of a head rail of an example architectural covering. For example, because a power source may be located at different locations with respect to the motor assembly, the cable may be routed in different configurations with respect to the end cap. The cable has a length that is long enough to reach a power source disposed at different locations relative to the motor assembly. In some positions, the cable may have excess length relative to the position of the power source with respect to the motor assembly. The end cap may facilitate management of excess length of the cable when the cable is coupled with a power source located proximate to the motor assembly as compared to when the cable is coupled to a power source located further from the motor assembly. Although example method 800 is disclosed with reference to the flowchart illustrated in FIG. 8, many other methods of managing a power cable using an end cap of a head rail of an architectural covering may alternatively be used. For example, the order of execution of the blocks may be changed, and/or some of the blocks described may be changed, eliminated, or combined.

Example method 800 includes coupling the motor assembly to the end cap of the head rail of the architectural covering (block 802). For example, first end 122 of example motor assembly 118 of FIG. 1 is removably coupled to first end cap 104 via motor mount 200 and connector portion 201 of first end cap 104, as illustrated in FIGS. 2-6. Motor assembly 118 extends through the connector portion 201 to second surface 128 of first end cap 104 such that cable 120 can be accessed from second surface 128 of first end cap 104.

Example method 800 includes routing the cable from the motor assembly to a power source via the end cap. In the example method 800, routing the cable to the power source includes routing the cable from the motor assembly to a cable-directing element of the end cap (block 804). For example, first portion 304 of cable 120 is routed via shared cable-routing element 302 formed in second surface 128 of first end cap 104 to cable transition element 300 of first end cap 104, as illustrated in FIG. 3. Transition portion 306 of cable 120 is inserted into cable transition element 300 to access cable-directing element 308 disposed on first surface 126 of first end cap 104, as illustrated in FIGS. 3-6.

Example method 800 includes positioning the cable with respect to the cable-directing element (block 806). For example, transition portion 306 of cable 120 may be positioned with respect to protrusion 402 of cable-directing element 308 such that transition portion 306 substantially wraps around post 404 of cable-directing element 308 (e.g., is held against post 404 by protrusion 402), as illustrated in FIGS. 3-6. In some examples, a user tightens transition portion 306 of cable 120 when transition portion 306 is wrapped around post 404. Cable-directing element 308 re-directs second portion 310 of cable 120 toward second surface 128 for coupling with power source 124 in first wire routing configuration 315 or second wire routing configuration 601.

Example method 800 includes routing a remainder of the cable including a pigtail of the cable in the end cap for coupling the cable to a power source for the motor assembly (block 808). For example, second portion 310 of cable 120 is routed from cable transition element 300 (e.g., an aperture) to first cable-routing element 312 in example first end cap 104 (e.g., first wire routing configuration 315). Thus, second portion 310 of cable 120 including pigtail 311 is disposed proximate to front edge 316 of first end cap 104, or, in some examples, when first end cap 104 is coupled to head rail 102, inside front portion 109 of head rail 102, for coupling to power source 124 when power source 124 is disposed proximate to inside front portion 109 of head rail 102. In other examples, second portion 310 of cable 120 is routed from cable transition element 300 to second cable-routing element 313 (e.g., a channel) and/or third cable-routing element 606 (e.g., a groove) of first end cap 104 (e.g., second wire routing configuration 601) for coupling with a power source disposed proximate to rear portion 110 of head rail 102. Thus, second portion 310 of cable 120 extending from cable transition element 300 can be routed in first wire routing configuration 315 or second wire routing configuration 601 for coupling pigtail 311 with power source 124.

Figure 9:
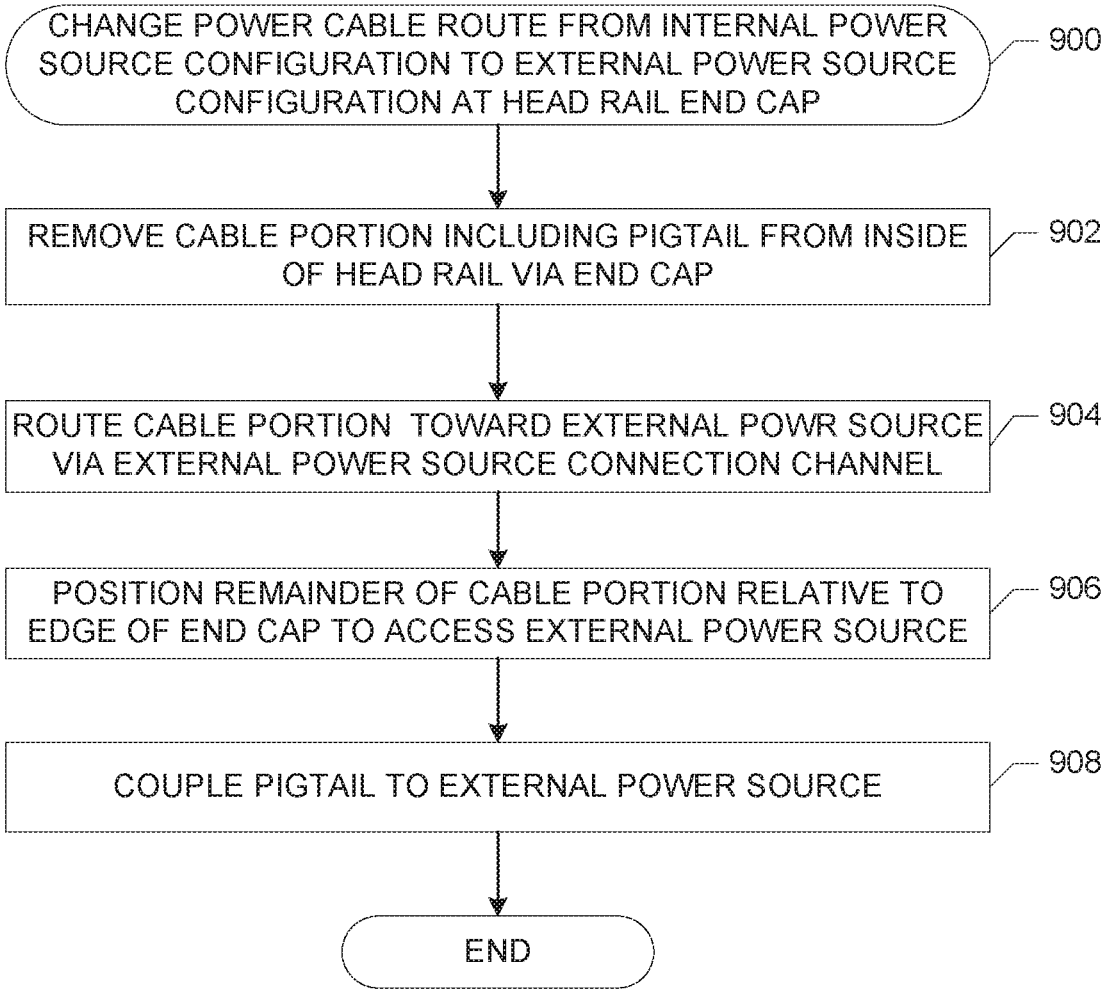
FIG. 9 is a flowchart representative of a process for changing a wire routing configuration of an example power cable at an example end cap of a head rail of an architectural covering in accordance with the teachings of this disclosure.

FIG. 9 is a flowchart illustrating example method 900 for changing a route of a power cable at an example end cap of a head rail of an example architectural covering from a first configuration for coupling with a power source disposed in a first position relative to the end cap (e.g., internal to the head rail or proximate to an inside front portion of the head rail) to a second configuration for coupling with a power source disposed in a second position relative to the end cap (e.g., external to the head rail or proximate to a rear outside portion of the head rail). For example, the end cap may be received from a manufacturer having the cable routed in the first wire routing configuration 315, an example of which is illustrated in FIG. 3. However, the power source of the architectural covering including the head rail to which the end cap is coupled may be disposed proximate to the rear portion of the head rail. Thus, a user (e.g., an installer of the architectural covering) may need to re-route the cable to direct the cable toward the rear portion of the head rail via the end cap to couple the cable to the power source. Example end caps disclosed herein provide cable-routing elements or structures that enable the user to re-route the cable for coupling with the power source in different positions relative to the end cap. Although example method 900 is disclosed with reference to the flowchart illustrated in FIG. 9, many other methods of changing a wire routing configuration of the cable may alternatively be used. For example, the order of execution of the blocks may be changed, and/or some of the blocks described may be changed, eliminated, or combined.

Example method 900 includes removing a portion of the cable including the pigtail or other electrical connection from an inside of the head rail via the end cap (block 902). For example, when second portion 310 of cable 120 is in first wire routing configuration 315 of FIGS. 3-5, pigtail 311 is disposed proximate to inside front portion 109 of head rail 102 via first cable-routing element 312 (e.g., an aperture) of first end cap 104. Second portion 310 of cable 120 including pigtail 311 can be removed from first cable-routing element 312 of first end cap 104 (e.g., by pulling second portion 310 of cable 120 out of first cable-routing element 312 (e.g., an aperture) using, for example, the user's hand or a tool such as a hook, screwdriver, pen, etc., such that second portion 310 is no longer disposed in first cable-routing element 312 and can be re-directed with respect to first end cap 104).

Example method 900 includes routing the portion of the cable including the pigtail toward the external power source via an external power source connection channel (block 904). For example, when second portion 310 of cable 120 is removed from first cable-routing element 312, second portion 310 of cable 120 can be routed via second cable-routing element 313 (e.g., a channel) such that second portion 310 extends toward rear edge 318 of first end cap 104, or the edge disposed proximate to rear portion 110 of head rail 102 when first end cap 104 is coupled to head rail 102, as illustrated in FIG. 6. The routing of second portion 310 toward rear edge 318 of first end cap 104 enables pigtail 311 to be coupled with power source 124 when power source 124 is positioned proximate to rear portion 110 of head rail 102.

Example method 900 includes positioning a remainder of the portion of the cable including the pigtail relative to an edge of the end cap to access the external power source (block 906). For example, second portion 310 of cable 120 extending from second cable-routing element 313 can be disposed in third cable-routing element 606 (e.g., a groove formed in upper edge 602 of first end cap 104, as illustrated in FIG. 6). In some examples, third cable-routing element 606 enables pigtail 311 to pass from second surface 128 of first end cap to first surface 126 of first end cap 104 for coupling with power source 124 when power source 124 is proximate to rear edge 318 of first end cap 104 (e.g., rear portion 110 of head rail 102 when first end cap 104 is coupled to head rail 102). In some examples, second portion 310 of cable 120 can be accessed when cover 112 is coupled to second surface 128 of first end cap 104 via groove 606 formed in upper edge 602 of first end cap 104 that is not covered by cover 112.

Example method 900 includes coupling the pigtail of the cable to the external power source (block 908). For example, pigtail 311 can be coupled to power source 124 in examples where power source 124 is disposed proximate to rear portion 110 of head rail 102 when second portion 310 is routed via second cable-routing element 313 and/or third cable-routing element 606. In some examples, pigtail 311 is coupled to an extension power cord, which is coupled to power source 124.

Thus, example method 900 provides for selective routing of the cable from a position proximate to an inside front portion of the head rail to a position proximate to a rear portion of the head rail based on the position of the power source via the end cap and via one or more cable-routing elements or structures provided by the end cap. However, the cable could be selectively routed from a position proximate to a rear portion of the head rail to a position proximate to an inside front portion of the head rail via the end cap. Thus, the example end cap provides for routing of the cable in different configurations via the cable-routing structures of the end cap and without requiring the user to disassemble the head rail and/or manipulate the cable inside the head rail, which could result in user interference with, for example, the shading material and/or user difficulties in accessing the cable. Also, as only the portion of the cable including the pigtail (e.g., the second portion 310 of the cable 120) is rerouted, the coupling of the portion of the cable to the cable-directing element as disclosed in connection with example method 800 of FIG. 8 is maintained. Thus, in some examples, the end cap provides for strain relief when the cable is routed in the first wire routing configuration 315 proximate to a front of the head rail and when the cable is routed in second wire routing configuration 601 proximate to a rear of the head rail. Further, the end cap may provide strain relief during re-routing of the cable from first wire routing configuration 315 to second wire routing configuration 601.

FIGS. 1-9 illustrate examples of end caps in which a cable can be selectively routed in different configurations via the end caps. In the example ends caps of FIGS. 1-9, the end caps provide strain relief with respect to the cable and the motor as the user manipulates the cable between the different routing configurations to couple the cable to power sources located in different locations relative to the head rail (e.g., inside the head rail, spaced apart from the architectural covering). In accordance with another embodiment of the disclosure, examples of end caps disclosed herein provide for routing of the cable in one routing configuration. Such example end caps may be used when a location of the power source to which the cable is to be coupled does not change based on, for example, an availability of a power source when the architectural covering is installed in a room. For example, the location of the power source may be known prior to installation of the architectural covering (e.g., such as when the power source is located in the head rail) and is not expected to change (e.g., the cable will not be selectively coupled to an electrical outlet spaced apart from the head rail). In such examples, the cable is routed via the end cap in the routing configuration provided by the end cap. After the cable is routed through the end cap in the routing configuration, at least a portion of the cable is coupled to a cable retainer that is separate from the end cap. The cable retainer may be coupled to a portion of the headrail and provides strain relief for the cable when the cable is coupled to the power source. In such examples, at least a portion of the cable is secured via the end cap to provide for further strain relief and/or to reduce interference between the cable and other components in the head rail by routing the cable through the end cap to manage a length of the cable.

Figure 10:
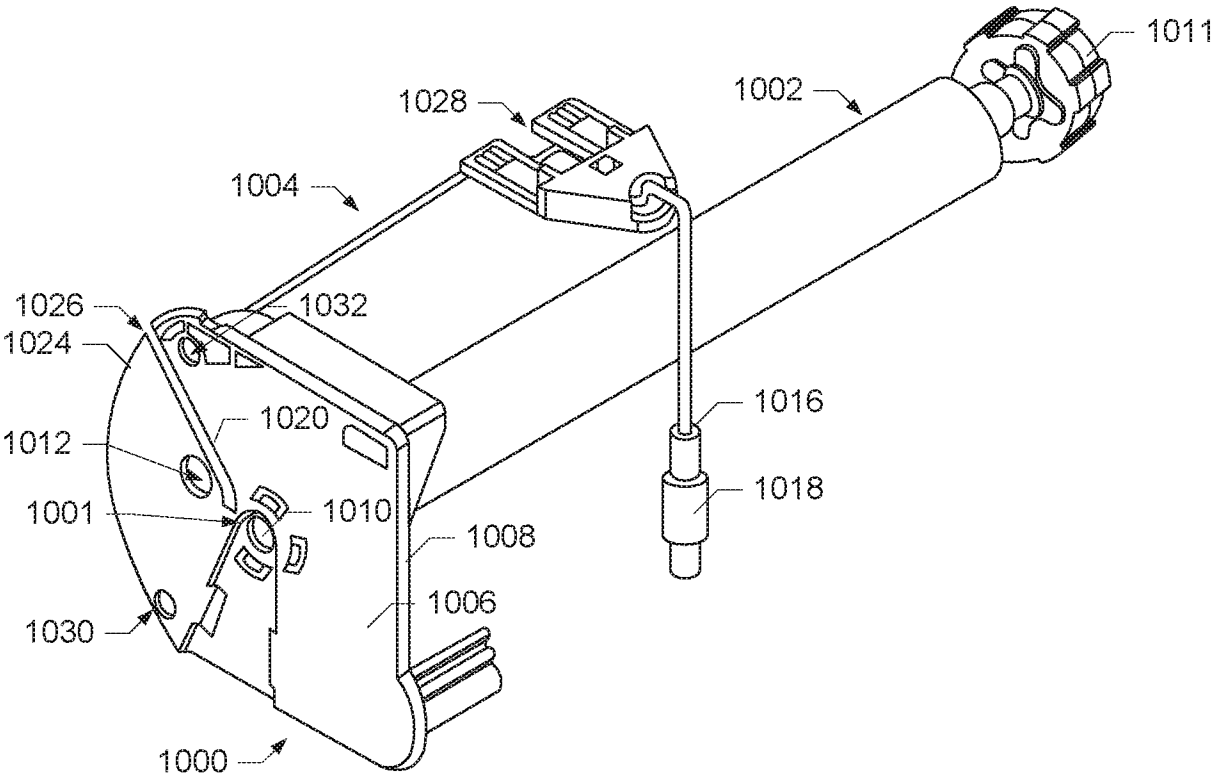
FIG. 10 is a right, front perspective view of another example of an end cap that may be used with the architectural covering of FIG. 1.

FIG. 10 is a right, perspective view of an example of an end cap including a motor assembly coupled thereto. The example end cap illustrated in FIG. 10 provides a path for routing a cable of the motor assembly in a wire routing configuration to manage a length of the cable. The example end cap of FIG. 10 may be used, for instance, when a cable is to be coupled to a power source for the motor assembly that is positioned in a first position (e.g., a power source coupled to an interior or exterior surface of a head rail) and the cable will not be re-routed after installation to couple to a power source positioned in a second position (e.g., a position spaced apart from the architectural covering). For example, the end cap of FIG. 10 may be used when a location of the power source is known prior to installation, as compared to examples in which a location of a power source for the motor assembly may vary relative to the head rail (e.g., the power source may be located inside the head rail or may be spaced apart from the head rail).

For example, end cap 1000 of FIG. 10 may be used with architectural covering 100 of FIG. 1. As illustrated in FIG. 10, motor assembly 1002 is coupled to end cap 1000. In some examples, motor assembly 1002 of FIG. 10 is the same or substantially the same as motor assembly 118 of FIG. 1. Motor assembly 1002 includes cable 1004 coupled thereto. Cable 1004 couples motor assembly 1002 to a power source such as a battery pack, a line power source, etc., as substantially disclosed above in connection with cable 120 of FIGS. 1-7.

In the example of FIG. 10, end cap 1000 includes first surface 1006 and second surface 1008. When end cap 1000 is coupled to a head rail such as head rail 102 of FIG. 1, first surface 1006 is an outer or room-facing surface. In the example of FIG. 10, end cap 1000 includes motor mount 1001. As discussed below in connection with FIG. 13, motor mount 1001 includes a connector portion coupled to second surface 1008 of end cap 1000. The connector portion of motor mount 1001 receives first end 1010 of motor assembly 1002 to removably couple motor assembly 1002 to end cap 1000. In some examples, second end 1011 of motor assembly 1002 is coupled to a second end cap (e.g., second end cap 106 of FIG. 1).

End cap 1000 includes cable receiver 1012 formed between first surface 1006 and second surface 1008. Cable receiver 1012 can include, for example, an aperture defined in surfaces 1006, 1008 of end cap 1000. In operation, a user pulls cable 1004 through cable receiver 1012 such that end 1016 of cable 1004 is accessible via first surface 1006 of end cap 1000. In some examples, end 1016 of cable 1004 includes pigtail 1018.

End cap 1000 includes cable-routing element 1020, which can include a channel or track. Cable-routing element 1020 guides at least a portion of cable 1004 when cable 1004 is routed via end cap 1000 for coupling with a power source. In the example of FIG. 10, cable-routing element 1020 is formed on first surface 1006 proximate to cable receiver 1012. Cable-routing element 1020 can have a different shape and/or size than illustrated in FIG. 10. For example, cable-routing element 1020 can have a substantially curved shape. In some examples, cable-routing element 1020 may include substantially linear portion(s) and substantially curved portion(s).

In the example of FIG. 10, at least a portion of cable-routing element 1020 extends from cable receiver 1012 proximate to an edge 1024 of end cap 1000 to facilitate a transition of cable 1004 from first surface 1006 to second surface 1008. Edge 1024 defines a side of end cap 1000 (e.g., a right side of end cap 1000). End cap 1000 includes cable-directing element or cable director 1026 formed between first surface 1006 and second surface 1008 proximate to edge 1024. As discussed below in more detail, cable director 1026 includes a slot or aperture formed between first and second surfaces 1006, 1008 to receive a portion of cable 1004 to route end 1016 of cable 1004 from first surface 1006 to second surface 1008. In other examples, cable director 1026 is formed on end cap 1000 at a different position than illustrated in FIG. 10. For example, cable director 1026 can include an aperture formed between first surface 1006 and second surface 1008 proximate to motor mount 1001. Thus, in some examples, cable director 1026 is spaced apart from edge 1024. In such examples, a direction in which cable-routing element 1020 extends relative to edge 1024 is based on the position of cable director 1026.

In accordance with one aspect of the disclosure, end cap 1000 holds at least a portion of cable 1004 when cable 1004 is coupled to a power source. Cable receiver 1012, cable-routing element 1020, and/or cable director 1026 respectively receive at least a portion of cable 1004 and retain the portion(s) when cable 1004 is coupled to a power source. Thus, cable receiver 1012, cable-routing element 1020, and/or cable director 1026 provide for strain relief when cable 1004 is coupled to a power source by reducing pulling forces on cable 1004 and/or motor assembly 1002. In accordance with the present disclosure, at least a portion of cable 1004 is received in a cable retainer to provide for additional strain relief when cable 1004 is coupled to a power source.

For example, as illustrated in FIG. 10, after cable 1004 passes through cable director 1026 and end 1016 of cable 1004 is accessible from second surface 1008 of end cap 1000, at least a portion of cable 1004 is coupled to cable retainer 1028. As discussed below in connection with FIGS. 15 and 16, cable retainer 1028 includes one or more channels (e.g., channel 1500 of FIG. 15) or pathways (e.g., pathway 1600 of FIG. 16) through which cable 1004 is threaded. In examples disclosed herein, the channel(s) and/or pathway(s) are substantially non-linear such that cable 1004 is weaved, wound, or directed about one or more curvatures, protrusions, etc. of the channel(s) and/or pathway(s). The weaving of cable 1004 through cable retainer 1028 reduces pulling forces exerted on cable 1004 and, thus, undue stress on motor assembly 1002, when cable 1004 is coupled to a power source as compared to if cable 1004 was routed through cable retainer 1028 in a substantially linear configuration. In operation, cable retainer 1028 may be coupled to a portion of a head rail (e.g., inside portion 109 of head rail 102 of FIG. 1). Thus, in some examples, cable retainer 1028 routes or directs at least a portion of cable 1004 that extends from end cap 1000 to an interior of the head rail to manage an excess length of cable 1004 that is not routed through end cap 100. For example, if a remainder of cable 1004 including end 1018 were allowed to freely hang within the head rail after passing through end cap 1000, cable 1004 could become tangled with other components disposed in the head rail (e.g., a power source, a rotary tube, shading material, etc.) and/or could be subject to wear due to twisting. Instead, cable retainer 1028 manages or guides at least a portion of cable 1004 within the head rail to reduce interference between cable 1004 and other components. For example, when cable retainer 1028 is coupled to an interior surface of the head rail, cable retainer 1028 routes at least a portion of cable 1004 (e.g., a portion of cable 1004 extending from end cap 1000 to cable retainer 1028) along the head rail surface to which cable 1028 is coupled. Thus, cable retainer 1028 reduces interference between cable 1004 and other components in the head rail by routing cable 1004 within the head rail.

As shown in FIG. 10, end cap 1000 includes first cover connector 1030 and second cover connector 1032. First cover connector 1030 and second cover connector 1032, which may be substantially the same as cover connectors 208, 210 of FIG. 2, include apertures that enable connectors (e.g., mechanical fasteners such as screws, tabs) to couple a cover (e.g., cover 112 of FIGS. 1 and 7) to first surface 1006 of end cap 1000. First surface 1006 of end cap 1000 can include additional or fewer cover connectors configured to permit coupling of a cover to end cap 1000 than illustrated in FIG. 10. In other examples, a cover is coupled to end cap 1000 using a chemical fastener or other types of fasteners.

Figure 11:
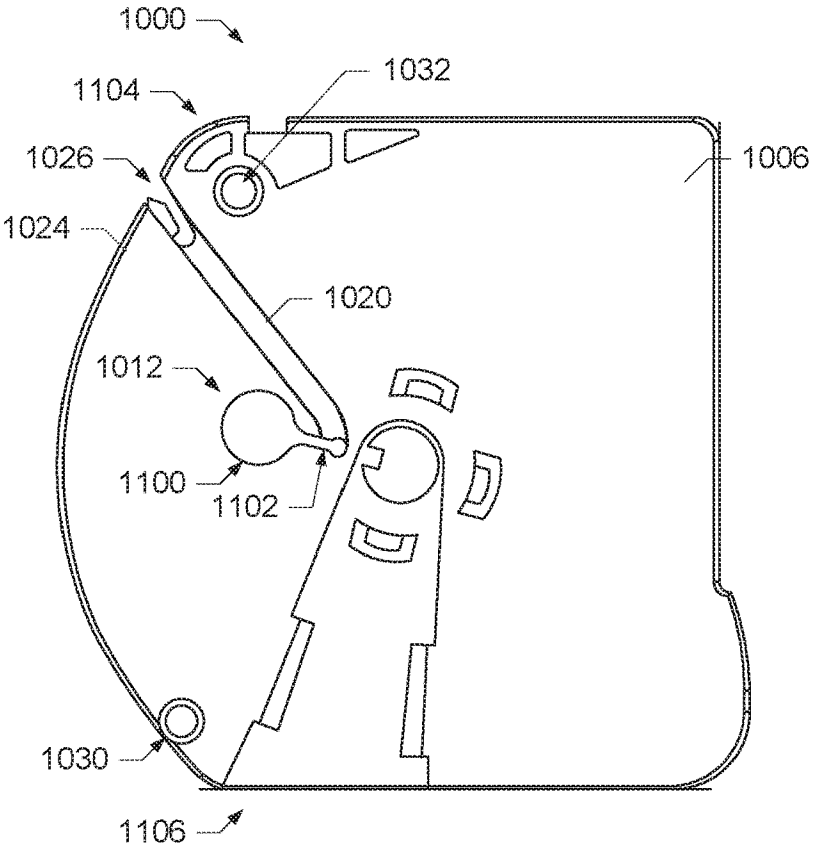
FIG. 11 is a front view of the end cap of FIG. 10.

FIG. 11 is a front view of end cap 1000 of FIG. 10. For illustrative purposes, cable 1004 is not shown in FIG. 11. As illustrated in FIG. 11, cable receiver 1012 includes first receiving portion 1100 and second receiving portion 1102. First receiving portion 1100 of cable receiver 1012 includes an aperture formed in first surface 1006 to enable end 1016 of cable 1004 and, in some examples, pigtail 1018, to pass through cable receiver 1012. Second receiving portion 1102 of cable receiver 1012 includes an aperture to hold a portion of cable 1004 while a remainder of cable 1004 is routed via end cap 1000 (e.g., via cable-routing element 1020 and cable director 1026). As illustrated in FIG. 11, a size of second receiving portion 1102 of cable receiver 1012 is less than a size of first receiving portion 1100. For example, a size of first receiving portion 1100 can be based on a size of pigtail 1018 to provide clearance to allow a user to pull end 1016 of cable 1004 including pigtail 1018 through first receiving portion 1100. A size of second receiving portion 1102 can be based on a size of cable 1004 not including pigtail 1018 so as to allow at least a portion of cable 1004 to be received in and substantially securely held by second receiving portion 1102 while a remainder of cable 1004 is routed via end cap 1000, as discussed below in connection with FIG. 12. First receiving portion 1100 and/or second receiving portion 1102 of cable receiver 1012 can have different shapes and/or sizes than illustrated in FIG. 11.

As illustrated in FIG. 11, cable-routing element 1020 extends from second receiving portion 1102 of cable receiver 1012 toward upper portion 1104 of end cap 1000 when end cap 1000 is coupled to a head rail (e.g., head rail 102 of FIG. 1) and the head rail is installed over an architectural covering. As also illustrated in FIG. 11, cable director 1026 is formed between cable-routing element 1020 and edge 1024 of end cap 1000 proximate to upper portion 1104. Cable director 1026 can include a slot or groove formed in first surface 1006 of end cap 1000. In other examples, cable-routing element 1020 extends from second receiving portion 1102 of cable receiver 1012 toward bottom portion 1106 of end cap 1000, or a portion of end cap 1000 opposite upper portion 1104. In such examples, cable director 1026 is formed between cable-routing element 1020 and edge 1024 of end cap 1000 proximate to bottom portion 1106.

Figure 12:
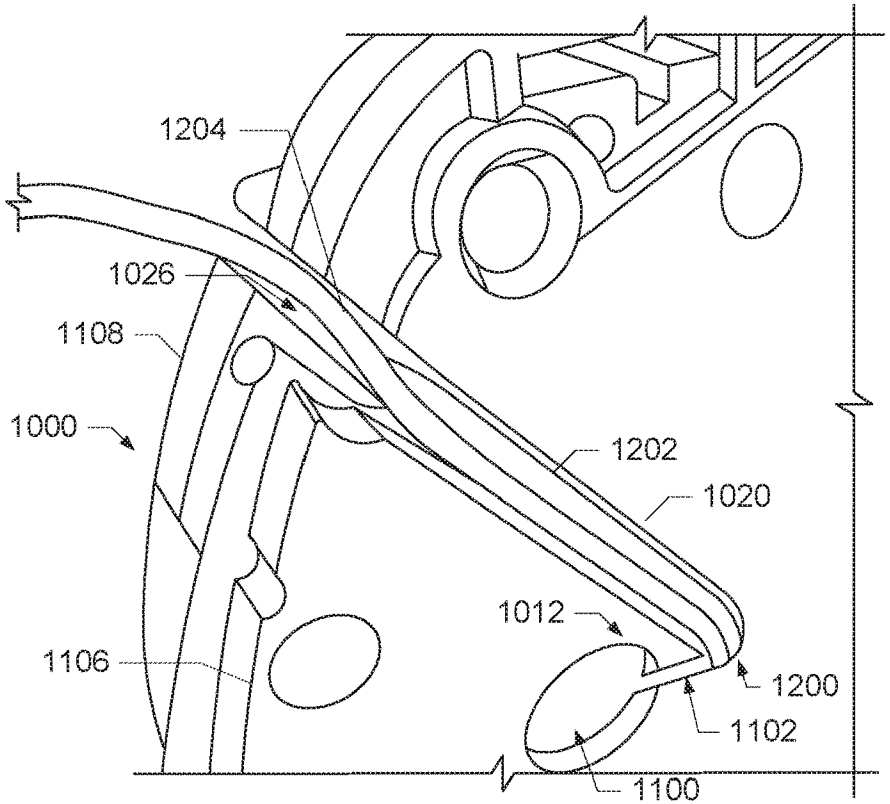
FIG. 12 is a partial, left, front perspective view of the example of the end cap of FIG. 10.

FIG. 12 is a partial left, front perspective view of example end cap 1000 including cable 1004. As illustrated in FIG. 12, first portion 1200 of cable 1004 is disposed in second receiving portion 1102 of cable receiver 1012. For example, after user passes end 1016 through first receiving portion 1100 of cable receiver 1012, the user can slide first portion 1200 of cable 1004 into second receiving portion 1102 of cable receiver 1012 such that second receiving portion 1102 holds first portion 1200 of cable 1004.

As also shown in FIG. 12, second portion 1202 of cable 1004 is disposed in cable-routing element 1020. For example, second portion 1202 of cable 1004 can be press fit into cable-routing element 1020 by the user. Thus, cable-routing element 1020 substantially secures second portion 1202 of cable 1004 into cable-routing element 1020. In some examples, a cover coupled to end cap 1000 further secures second portion 1202 of cable 1004 in cable-routing element 1020.

As also shown in FIG. 12, third portion 1204 of cable 1004 is received in cable director 1026. For example, third portion 1204 of cable 1004 can be slid into or press fit into cable director 1026. As also shown in FIG. 12, cable director 1026 serves as a transition point for cable 1004 that directs cable 1004 from being accessible via first surface 1006 of end cap 1000 to being accessible via second surface 1008 of end cap 1000. In some examples, a width of cable director 1026 is selected so as to substantially secure third portion 1204 in cable director 1026 to prevent sliding of cable 1004 relative to cable director 1026. For example, a width of cable director 1026 may be smaller (e.g., slightly smaller) than a width of cable 1004. As such, third portion 1204 of cable 1004 is compressed when third portion 1204 is disposed in cable director 1026, thereby providing for a substantially tight fit between the cable 1004 and the cable director 1026 to prevent sliding of cable 1004. In some examples, the coupling of third portion 1204 of cable 1004 to cable director 1026 provides tension to second portion 1202 of cable 1004 disposed in cable-routing element 1020 and, thus, reduces excessive slack of cable 1004 relative to cable-routing element 1020. Thus, second portion 1202 of cable 1004 is substantially contained within (e.g., lies substantially flat in) cable-routing element 1020, which facilitates ease of coupling a cover to end cap 1000.

Figure 13:
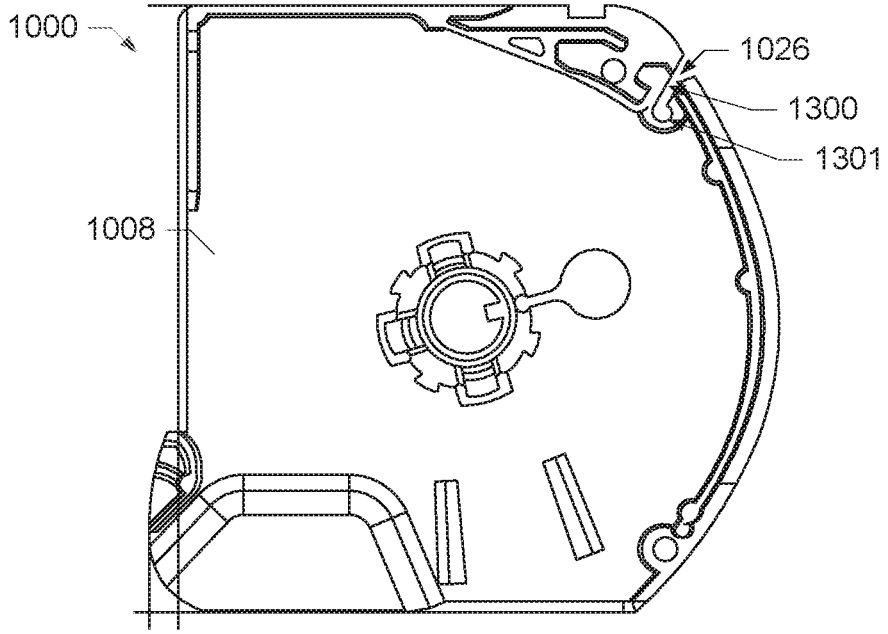
FIG. 13 is a rear view of the example of the end cap of FIG. 11.

FIG. 13 is a rear view of end cap 1000 of FIG. 10. For illustrative purposes, cable 1004 is not shown in FIG. 13. As illustrated in FIG. 13, cable director 1026 is formed between first surface 1006 of end cap 1000 shown in FIGS. 10-12 and second surface 1008 of end cap 1000. In accordance with one example of the present disclosure, cable director 1026 is substantially L-shaped such that cable director 1026 includes receiver portion 1300 and holder or hook portion 1301. A user can slide third portion 1204 of cable 1004 into cable director 1026 via receiver portion 1300. Hook portion 1301 receives and holds third portion 1204 of cable 1004 (as shown in FIG. 12). Thus, hook portion 1301 substantially secures third portion 1204 of cable 1004 to reduce movement of cable 1004 when cable 1004 is disposed in cable director 1026. For example, hook portion 1301 reduces an ability of cable 1004 to move or lift out of cable director 1026, which could cause at least a portion of cable 1004 to move out of cable-routing element 1020. Thus, hook portion 1301 facilitates securing of cable 1004 with respect to end cap 1000.

Figure 14:
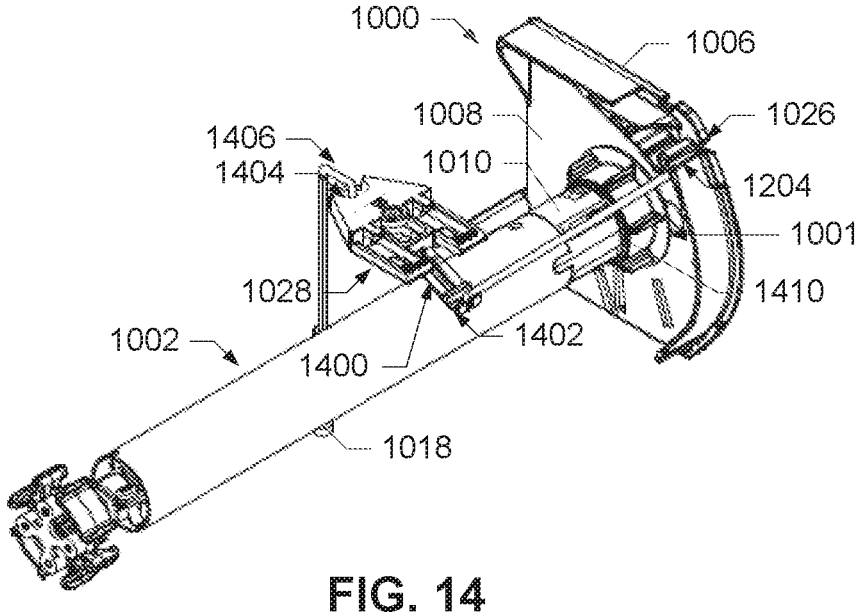
FIG. 14 is a left, rear perspective view of the example of the end cap of FIG. 10.

FIG. 14 is a left, rear perspective view of the example of end cap 1000 of FIG. 10. As illustrated in FIG. 14, third portion 1204 of cable 1004 passes from first surface 1006 of end cap 1000 to second surface 1008 of end cap 1000 via cable director 1026. After passing through cable director 1026, a remainder of cable 1004 is accessible via second surface 1008 of end cap 1000. As illustrated in FIG. 14, fourth portion 1400 of cable 1004 is received in first opening 1402 of cable retainer 1028. Cable 1004 extends through cable retainer 1028 and exits cable retainer 1028 via second opening 1404 of cable retainer 1028. Fifth portion 1406 of cable 1004, which can include pigtail 1018, extends from second opening 1404 to enable cable 1004 to be coupled to a power source.

As also shown in the example illustrated in FIG. 14, second surface 1008 of end cap 1000 includes motor mount 1001 to receive first end 1010 of motor assembly 1002. Motor mount 1001 includes a connector portion 1410 to which motor assembly 1002 is removably coupled (e.g., via a mechanical fastening) substantially as disclosed above in connection with motor mount 200 of FIG. 4. Thus, end cap 1000 provides for coupling of motor assembly 1002 and routing of cable 1004. In examples where a user does not change a power source for the motor assembly 1002 and, thus, may not need to adjust a configuration of cable 1004, end cap 1000 of FIGS. 10-14 provides for secure routing of cable 1004 to reduce strain on cable 1004. End cap 1000 manages a length of cable 1004 relative to the head rail to prevent interference with other components in the head rail as compared to if all of cable 1004 was disposed in the head rail and/or not disposed in channels or secured in the head rail, etc.

As mentioned above, in accordance with one aspect of the disclosure, cable 1004 is coupled to a cable retainer after being routed via end cap 1000. The cable retainer provides additional strain relief for cable 1004. Further, the cable retainer can route a portion of cable 1004 inside a head rail when the cable retainer is coupled to the head rail. Therefore, the cable retainer also reduces interference between cable 1004 and other components of the head rail.

Figure 15:
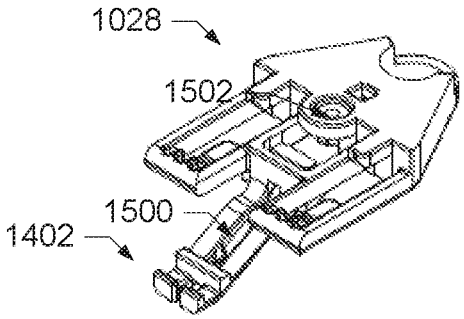
FIG. 15 is a top, right view of an example of a cable retainer that may be used with the end cap of FIGS. 10-14.
Figure 16:
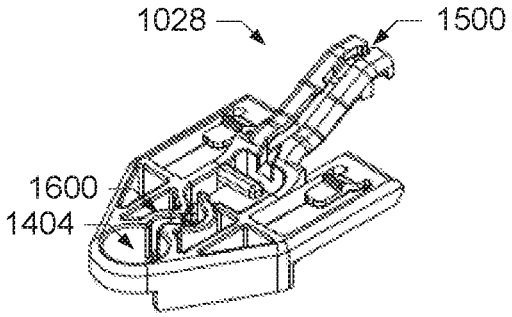
FIG. 16 is a bottom, right view of the example of the cable retainer of FIG. 14.

For example, FIG. 15 is a right, top perspective view of an example of cable retainer 1028. FIG. 16 is a left, bottom perspective view of the example of cable retainer 1028 of FIG. 15. For illustrative purposes, cable 1004 is not shown in FIGS. 15 and 16. As shown in FIG. 15, first opening 1402 of cable retainer 1028 includes channel 1500 to receive cable 1004. Referring to FIG. 16, channel 1500 routes cable 1004 through cable retainer 1028 to pathway 1600. In accordance with one aspect of the disclosure, pathway 1600 has a substantially curved shape. The substantially curved shape of pathway 1600 provides for strain relief with respect to cable 1004 by reducing pulling forces on the cable 1004 when a user couples cable 1004 to a power source as compared to if cable 1004 was pulled substantially straight when coupled to the power source. Pathway 1600 of cable retainer 1028 can have other shapes than illustrated in FIG. 16.

As illustrated in FIG. 16, pathway 1600 extends to second opening 1404 of cable retainer 1028. In operation, a user may couple cable 1004 to cable retainer 1028 by press fitting cable 1004 into channel 1500 and pathway 1600. Second opening 1404 can have a diameter such the user is able to pass end 1016 of cable 1004 including pigtail 1018 through second opening 1404.

Referring again to FIG. 15, cable retainer 1028 includes head rail connector 1502 to enable cable retainer 1028 to be coupled to a head rail via, for example, a mechanical fastener (e.g., a screw). When cable 1004 is disposed in channel 1500 and pathway 1600 and cable retainer 1028 is coupled the head rail via head rail connector 1502, movement of the portion(s) of the cable 1004 coupled to cable retainer 1028 is substantially restricted. Thus, cable retainer 1028 reduces pulling forces on the cable 1004 and, thus, motor assembly 1002 when end 1016 of cable 1004 is coupled to a power source.

Figure 17:
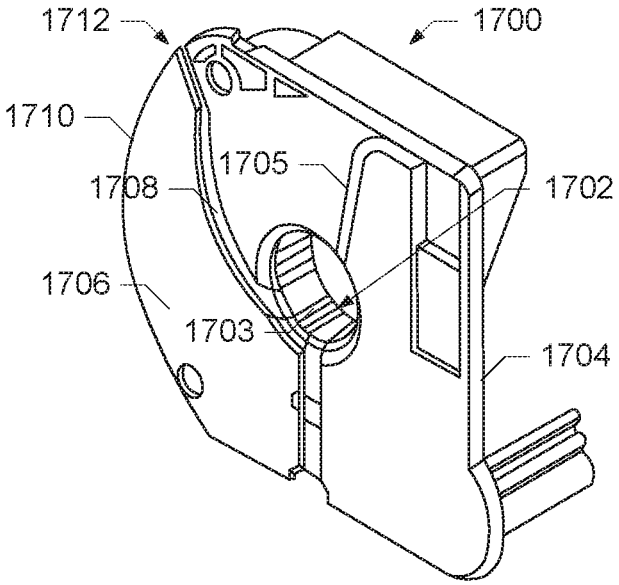
FIG. 17 is a front view of another example of an end cap that may be used with the architectural covering of FIG. 1.

In some examples, the end cap does not include cable receiver 1012 shown in FIGS. 10-12. Rather, the motor assembly can couple to the end cap such that the cable can be accessed via an opening in the end cap that receives at least a portion of the motor assembly. In such examples, the end cap can include a cable routing element (e.g., a channel) disposed proximate to the opening that receives the motor assembly such that the cable may be directed from the motor assembly to the cable routing element. Such example end caps may be used to substantially contain the cable within the cable routing element to hold the cable substantially flat relative to the end cap, prevent twisting of the cable, and to facilitate coupling of a cover to the end cap. For example, FIG. 17 is a front view of another example end cap 1700. End cap 1700 may be used with architectural covering 100 of FIG. 1. For illustrative purposes, the motor assembly and cable are not shown in FIG. 17.

End cap 1700 of FIG. 17 includes a motor mount 1702 that enables a motor assembly to be coupled to end cap 1700. Motor mount 1702 includes a connector portion 1703 disposed on first surface 1704 of end cap 1700 such that a cable coupled to the motor assembly is accessible via second surface 1706 of end cap 1700 when motor assembly is coupled to motor mount 1702. Motor mount 1702 includes a connector portion to receive an end of the motor assembly as substantially discussed above in connection with motor mount 1001 and connector portion 1408 of FIGS. 10-14. End cap 1700 includes antenna channel or track 1705 to receive an antenna of the motor assembly, substantially as discussed above in connection with antenna channel 202 of FIG. 2.

End cap 1700 includes a cable-routing element 1708. Cable-routing element 1708 guides at least a portion of the cable when the cable is routed via end cap 1700 for coupling with a power source substantially as disclosed above in connection with cable-routing element 1020 of FIG. 10. In the example of FIG. 17, cable-routing element 1708 is formed on second surface 1706 of end cap 1700 proximate to motor mount 1702. Cable-routing element 1708 can include a track or channel. In operation, at least a portion of the cable is press fit into cable-routing element 1708 to secure and route the cable for coupling with the power source. Cable-routing element 1708 can have other shapes than illustrated in FIG. 17.

In the example of FIG. 17, cable-routing element 1708 extends proximate to edge 1710 of end cap 1700 to facilitate a transition of cable 1004 from first surface 1006 to second surface 1008. End cap 1700 includes a cable-directing element or cable director 1712 formed between surfaces 1704, 1706 of end cap 1700 proximate to edge 1710. Cable director 1712 routes the cable from second surface 1706 to first surface 1704 substantially as discussed in connection with cable director 1026 of FIG. 10. Cable director 1712 of FIG. 17 can include a slot or groove to receive at least a portion of the cable similar or identical to cable director 1026 of FIG. 10. Thus, end cap 1700 provides for routing and securing of a cable via cable-routing element 1708 and cable director 1712. In other examples, cable director 1712 is formed on end cap 1700 at a different location than illustrated in FIG. 17. For example, cable director 1712 may be spaced apart from edge 1710 and, for instance, may be disposed proximate to motor mount 1702. In such examples, a direction in which cable-routing element 1708 extends relative to edge 1710 is based on the position of cable director 1712.

Figure 18:
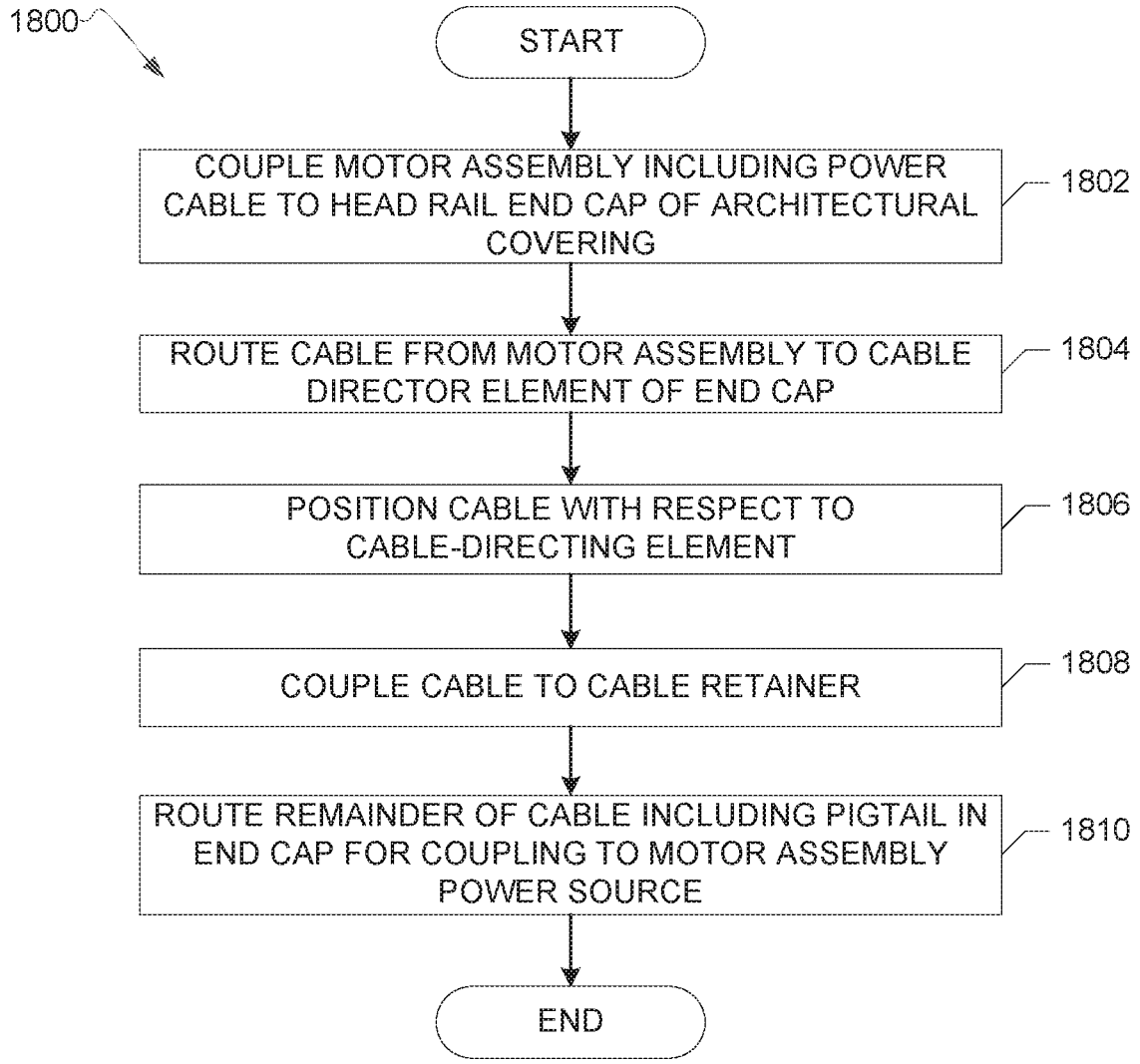
FIG. 18 is a flowchart representative of another process for coupling an example motor assembly including a power cable to an example end cap of a head rail of an architectural covering in accordance with the teachings of this disclosure.

FIG. 18 is a flowchart illustrating example method 1800 for managing a power cable via an example end cap of a head rail of an example architectural covering. For example a cable of an end cap may be routed via the end cap for coupling with a power source. For example, because a power source may be located at different locations with respect to the motor assembly, the cable has a length that is long enough to reach a power source disposed at a different location relative to the motor assembly. The end cap may facilitate management and securing of the cable to reduce interference between the cable and other components of a head rail including the motor assembly. Although example method 1800 is disclosed with reference to the flowchart illustrated in FIG. 18, many other methods of managing a power cable using an end cap of a head rail of an architectural covering may alternatively be used. For example, the order of execution of the blocks may be changed, and/or some of the blocks described may be changed, eliminated, or combined.

Example method 1800 includes coupling the motor assembly to the end cap of the head rail of the architectural covering (block 1802). For example, first end 1010 of example motor assembly 1002 of FIG. 10 is removably coupled to end cap 1000 via motor mount 1001, 1702 and connector portion 1410 of end cap 1000, as illustrated in FIGS. 10-17. Motor assembly 1002 extends through the connector portion 1408 such that cable 1004 can be accessed from surface 1006, 1704 of end cap 1000, 1700.

Example method 1800 includes routing the cable from the motor assembly to a power source via the end cap. In the example method 1800, routing the cable to the power source includes routing the cable from the motor assembly to a cable director element of the end cap (block 1804). For example, cable 1004 is routed via cable receiver 1012 and cable-routing element 1020 formed in first surface 1006 of end cap 1000 to cable director 1026 of end cap 1000, as illustrated in FIGS. 10-14. In another example, the cable is routed from the motor assembly to cable director 1712 via cable-routing element 1708 as illustrated in FIG. 17.

Example method 1800 includes positioning the cable with respect to a cable-directing element (block 1806). For example, third portion 1204 of cable 1004 may be disposed in hook portion 1301 of cable director 1026 such that third portion 1204 of cable 1004 is substantially secured in cable director 1026. When the cable is disposed in cable director 1026, 1712, an end of the cable may be access via a surface of the end cap facing an interior of the head rail when the end cap is coupled to the head rail.

Example method 1800 includes coupling the cable to a cable retainer (block 1808). For example, fourth portion 1400 of cable 1004 may be weaved through one or more channels or pathways 1500, 1600 in cable retainer 1028. Channels and/or pathways 1500, 1600 can include substantially non-linear portions (e.g., curvatures, protrusions, etc.) about which fourth portion 1400 of cable 1004 is wound, weaved, or directed. As a result of the weaving of cable 1004 along the channels and/or pathways 1500, 1600, cable retainer 1028 substantially restrains movement of cable 1004 and, thus, provides strain relief when cable 1004 is coupled to a power source.

Example method 1800 includes routing a remainder of the cable including a pigtail of the cable in the end cap for coupling the cable to a power source for the motor assembly (block 1810). For example, fifth portion 1406 of cable 1004 including pigtail 1018 can be positioned proximate to a power source for coupling to the power source. Thus, end cap 1000, 1700 and cable retainer 1028 substantially secure at least a portion of cable 1004 to reduce pulling forces on cable 1004 and/or the motor assembly when cable 1004 is coupled to the power source and to reduce interference between the cable 1004 and other components of the head rail.

From the foregoing, it will be appreciated that the above-disclosed methods and apparatus provide an end cap for a head rail of an architectural covering that facilitates routing of a power cable of a motor assembly coupled to the end cap in one or more routing configurations (e.g., in two or more configurations) while optionally also providing strain relief for the cable. Example end caps disclosed herein allow the cable to be selectively routed to couple with a power source disposed inside of the head rail or external to the head rail via one or more cable-routing elements or structures (e.g., channels and/or apertures) provided by the end cap. The selective routing of the cable via example end caps disclosed herein reduces a number of end cap part styles required to accommodate the cable in different positions relative to the location of the power source and, thus, reduces manufacturing costs. Example end caps disclosed herein allow the routing of the cable to be readily switched for coupling with a power source disposed inside or outside of the head rail and/or in different orientations of inside and outside positioning. Further, example end caps disclosed herein may provide integrated strain relief that substantially reduces pulling forces exerted on the motor assembly to which the cable is coupled when the cable is in either routing configuration and/or during re-routing of the cable. Other example end caps substantially secure the cable in a routing configuration and provide strain relief in conjunction with, for example, a cable retainer.

An example end cap for an architectural covering includes a first cable-routing element provided in a first region of the end cap and a second cable-routing element provided in a second region of the end cap spaced apart from the first region of the end cap. The example end cap includes a cable-directing element and a motor mount configured to couple with a portion of a motor having a cable extending therefrom. In the example end cap, the cable-directing element is configured to engage a transition portion of the cable and to selectively route a second portion of the cable from the cable-directing element to either the first cable-routing element or the second cable-routing element.

In some examples, the cable-directing element is disposed on a first surface of the end cap and the second cable-routing element is disposed on a second surface of the end cap and opposite the first surface.

In some examples, the cable-directing element includes a hook having a post, the post configured to engage the transition portion of the cable.

In some examples, the first cable-routing element is an aperture provided in the first region of the end cap and the second cable-routing element is a first channel provided in the first surface of the end cap.

In some examples, the end cap further includes a shared cable-routing element provided in the first surface. In such examples, a first portion of the cable configured to be routed from the motor mount to the cable-directing element via the shared cable-routing element. In such examples, the first portion of the cable is to be routed via the shared cable-routing element when the second portion of the cable is configured to be routed via the first cable-routing element and when the second portion of the cable is configured to be routed via the second cable-routing element.

In some examples, the end cap further includes a cable transition element provided in the end cap. In such examples, the cable transition element is configured to route the transition portion of the cable for engaging with the cable-directing element.

In some examples, an edge of the end cap includes a third cable-routing element, the second cable-routing element configured to route the second portion of the cable to the third cable-routing element.

In some examples, the end cap further includes a cover fitted over a surface of the end cap.

An example architectural covering for an architectural structure includes shading material and an end cap having a first surface proximate to the shading material and a second surface opposite the first surface. The end cap includes a first cable-routing element provided in the second surface of the end cap and a second cable-routing element provided in the second surface of the end cap. The example architectural covering includes a motor having a first end coupled to the end cap. The motor includes a cable extending from the first end. The example architectural covering includes a power source to be positioned in one of a first position relative to the shading material or a second position relative to the shading material. In the example architectural covering, the first cable-routing element routes the cable in a first routing configuration when the power source is disposed in the first position and the second cable-routing element routes the cable in a second routing configuration when the power source is disposed in the second position.

In some examples, the architectural covering further includes a head rail having a first portion and a second portion, the first portion distal to the architectural structure and the second portion proximal to the architectural structure. In some such examples, in the first position, the power source is proximal to the first portion of the head rail, at least a portion of the cable to be routed proximal to the first portion of the head rail when the cable is in the first routing configuration. In other such examples, in the second position, said power source is proximal to the second portion of the head rail, at least a portion of the cable to be routed proximate to the second portion of the head rail when the cable is in the second routing configuration.

In some examples, the end cap includes a cable-directing element configured to engage at least a portion of the cable to direct the cable in the first routing configuration and the second routing configuration.

In some examples, the first cable-routing element is an aperture configured to receive at least a portion of the cable in the first routing configuration extending from the second surface of the end cap to the first surface of the end cap via the first aperture.

In some examples, the end cap includes a shared cable-routing element provided in the second surface of the end cap, the shared cable-routing element including a first channel and the second cable-routing element including a second channel. In such examples, in the second routing configuration, the first channel is configured to route a first portion of the cable and the second channel is configured to route a second portion of the cable.

In some examples, the surface of the end cap includes an antenna channel and the motor includes an antenna, the antenna channel configured to secure the antenna therein.

An example end cap of a head rail for an architectural covering includes a motor mount configured to receive a portion of a motor having a cable extending therefrom. The example end cap includes a first surface including a cable-directing element, a first cable-routing element proximal to a first portion of the end cap, and a second cable-routing element proximal to a second portion of the end cap. In the example end cap, the cable-directing element is configured to engage a transition portion of the cable and each of the first cable-directing element and the second cable-directing element is configured to selectively route a second portion of the cable for coupling with a power source for the motor based on a position of the power source relative to the end cap.

In some examples, the end cap includes a first portion proximal to an architectural structure and a second portion distal to the architectural structure and the second cable-routing element positions a pigtail of the cable proximal to the first portion of the end cap.

In some examples, the cable-directing element is configured to change a direction of a portion of the cable relative to the first surface of the end cap.

In some examples, the second cable-routing element is configured to extend proximal to a third cable-routing element provided in the end cap, the third cable-routing element of the end cap configured to route the second portion of the cable from the first surface of the end cap to a second surface of the end cap opposite the first surface.

In some examples, the first cable-routing element is configured to route the second portion of the cable to the power source disposed in a first position relative to the end cap. In such examples, the second cable-routing element is configured to route the second portion of the cable to the power source disposed in a second position relative to the end cap, the second position being different from the first position.

An example end cap for an architectural covering includes a motor mount and a shared cable-routing element extending from the motor mount to a cable transition element provided in a first region of the end cap. The example end cap includes a first cable-routing element extending from the cable transition element to the first region of the end cap and a second cable-routing element extending from said cable transition element to a second region of the end cap adjacent the first region of the end cap, the shared cable-routing element, the cable transition element, the first cable-routing element, and the second cable-routing element respectively dimensioned to route a power cable.

An example architectural covering for an architectural structure includes an end cap having a first surface proximate to shading material disposed in the architectural and a second surface opposite the first surface. The end cap includes a cable-routing element provided in the second surface of the end cap and a cable-directing element formed between the first surface and the second surface. The example architectural covering includes a motor having a first end coupled to the end cap. The motor includes a cable extending from the first end. The example architectural covering includes a cable retainer disposed in the architectural covering proximate to the second surface of the end cap. In the example architectural covering, a first portion of the cable is to be received in the cable-routing element, a second portion of the cable is to be received in the cable-directing element, and a third portion of the cable is to be coupled to the cable retainer. The cable-directing element is to transition the cable from the second surface to the first surface.

In some examples, the end cap further includes a cable receiver formed between the first surface and the second surface proximate to the motor. The cable receiver includes a first portion and a second portion, the second portion smaller than the first portion. In some such examples, a fourth portion of the cable is to be disposed in the second portion of the cable receiver when the first portion of the cable is received in the cable-routing element.

In some examples, the cable-directing element includes a first portion and a second portion. The second portion of the cable is to be disposed in the second portion of the cable-directing element when the third portion of the cable is coupled to the cable retainer.

Although certain example methods, apparatus and articles of manufacture have been disclosed herein, the scope of coverage of this patent is not limited thereto. On the contrary, this patent covers all methods, apparatus and articles of manufacture fairly falling within the scope of the claims of this patent.

What is claimed is:

1. An end cap for an architectural covering, said end cap comprising:

a first cable-routing element provided in a first region of said end cap;

a second cable-routing element provided in a second region of said end cap spaced apart from the first region of said end cap;

a cable-directing element; and a motor mount configured to couple with a portion of a motor having a cable extending therefrom;

wherein:

said cable-directing element is configured to engage a transition portion of the cable and to selectively route a second portion of the cable from said cable-directing element to either said first cable-routing element or said second cable-routing element.

2. The end cap of claim 1, wherein said cable-directing element is disposed on a first surface of said end cap and wherein said second cable-routing element is disposed on a second surface of said end cap and opposite said first surface.

3. The end cap of claim 1, wherein said cable-directing element includes a hook having a post, said post configured to engage the transition portion of the cable.

4. The end cap of claim 1, further including a cable transition element provided in said end cap, said cable transition element configured to route the transition portion of the cable for engaging with said cable-directing element.

5. The end cap of claim 1, wherein an edge of said end cap includes a third cable-routing element, said second cable-routing element configured to route the second portion of the cable to said third cable-routing element.

6. The end cap of claim 1, further including a cover fitted over a surface of said end cap.

7. The end cap of claim 1, wherein said first cable-routing element is an aperture provided in the first region of said end cap and said second cable-routing element is a first channel provided in said second region of said end cap.

8. The end cap of claim 7, further including a shared cable-routing element provided in said first region, a first portion of the cable configured to be routed from said motor mount to said cable-directing element via said shared cable-routing element, the first portion of the cable to be routed via said shared cable-routing element when the second portion of the cable is configured to be routed via said first cable-routing element and when the second portion of the cable is configured to be routed via said second cable-routing element.

9. An architectural covering for an architectural structure, said architectural covering comprising:

shading material;

an end cap having a first surface proximate to said shading material and a second surface opposite said first surface, wherein said end cap includes a first cable-routing element provided in said second surface of the end cap and a second cable-routing element provided in said second surface of the end cap;

a motor having a first end coupled to said end cap, said motor including a cable extending from said first end; and a power source to be positioned in one of a first position relative to said shading material or a second position relative to said shading material;

wherein:

said first cable-routing element routes said cable in a first routing configuration when said power source is disposed in the first position; and said second cable-routing element routes said cable in a second routing configuration when said power source is disposed in the second position.

10. The architectural covering of claim 9, wherein said end cap includes a cable-directing element configured to engage at least a portion of said cable to direct said cable in the first routing configuration and the second routing configuration.

11. The architectural covering of claim 9, wherein said first cable-routing element is an aperture configured to receive at least a portion of said cable in the first routing configuration extending from said second surface of said end cap to said first surface of said end cap via said aperture.

12. The architectural covering of claim 9, further including a head rail having a first portion and a second portion, said first portion distal to the architectural structure and said second portion proximal to the architectural structure.

13. The architectural covering of claim 12, wherein in the first position, said power source is proximal to said first portion of said head rail, at least a portion of said cable to be routed proximal to said first portion of said head rail when said cable is in the first routing configuration.

14. The architectural covering of claim 12, wherein in the second position, said power source is proximal to said second portion of said head rail, at least a portion of said cable to be routed proximate to said second portion of said head rail when said cable is in the second routing configuration.

15. The architectural covering of claim 9, wherein:

said end cap includes a shared cable-routing element provided in the second surface of the end cap, said shared cable-routing element including a first channel;

said second cable-routing element including a second channel; and in the second routing configuration, said first channel is configured to route a first portion of the cable and said second channel is configured to route a second portion of the cable.

16. The architectural covering of claim 15, wherein:

said second surface of said end cap includes an antenna channel and said motor includes an antenna, said antenna channel configured to secure said antenna therein.

17. An end cap of a head rail for an architectural covering, said end cap comprising:

a motor mount configured to receive a portion of a motor having a cable extending therefrom; and a first surface including a cable-directing element, a first cable-routing element proximal to a first portion of said end cap, and a second cable-routing element proximal to a second portion of said end cap;

wherein:

said cable-directing element is configured to engage a transition portion of the cable; and each of said first cable-routing element and said second cable-routing element is configured to selectively route a second portion of the cable for coupling with a power source for the motor based on a position of the power source relative to said end cap.

18. The end cap of claim 17, wherein:

said end cap includes a first portion proximal to an architectural structure and a second portion distal to the architectural structure; and said second cable-routing element positions a pigtail of the cable proximal to said first portion of said end cap.

19. The end cap of claim 17, wherein said cable-directing element is configured to change a direction of a portion of the cable relative to said first surface of said end cap.

20. The end cap of claim 17, wherein said second cable-routing element is configured to extend proximal to a third cable-routing element provided in said end cap, said third cable-routing element of said end cap configured to route the second portion of the cable from said first surface of said end cap to a second surface of said end cap opposite said first surface.

21. The end cap of claim 17, wherein:

said first cable-routing element is configured to route the second portion of the cable to the power source disposed in a first position relative to said end cap; and said second cable-routing element is configured to route the second portion of the cable to the power source disposed in a second position relative to said end cap, the second position being different from the first position.

22. An end cap for an architectural covering, the end cap comprising:

a motor mount;

a shared cable-routing element extending from the motor mount to a cable transition element provided in a first region of said end cap;

a first cable-routing element extending from said cable transition element to said first region of said end cap; and a second cable-routing element extending from said cable transition element to a second region of said end cap adjacent said first region of said end cap, said shared cable-routing element, said cable transition element, said first cable-routing element, and said second cable-routing element respectively dimensioned to route a power cable.

23. An architectural covering for an architectural structure, said architectural covering comprising:

an end cap having a first surface proximate to shading material disposed in said architectural covering and a second surface opposite said first surface, wherein said end cap includes a cable-routing element provided in said second surface of said end cap and a cable-directing element formed between said first surface and said second surface;

a motor having a first end coupled to said end cap, said motor including a cable extending from said first end; and a cable retainer disposed in said architectural covering proximate to said second surface of said end cap;

wherein:

a first portion of said cable is to be received in said cable-routing element, a second portion of said cable is to be received in said cable-directing element, and a third portion of said cable is to be coupled to said cable retainer, the cable-directing element to transition the cable from the second surface to the first surface.

24. The architectural covering of claim 23, wherein said cable-directing element includes a first portion and a second portion, said second portion of said cable to be disposed in said second portion of said cable-directing element when said third portion of said cable is coupled to said cable retainer.

25. The architectural covering of claim 23, wherein said end cap further includes a cable receiver formed between said first surface and said second surface proximate to said motor, said cable receiver including a first portion and a second portion, said second portion smaller than said first portion.

26. The architectural covering of claim 25, wherein a fourth portion of said cable is disposed in said second portion of said cable receiver when said first portion of said cable is received in said cable-routing element.

* * * * *